US011745525B2

(12) United States Patent
Fukasawa et al.

(10) Patent No.: US 11,745,525 B2
(45) Date of Patent: Sep. 5, 2023

(54) RECORDING APPARATUS, CONTROL METHOD, AND STORAGE MEDIUM

(71) Applicant: CANON KABUSHIKI KAISHA, Tokyo (JP)

(72) Inventors: Takuya Fukasawa, Kawasaki (JP); Takatoshi Nakano, Yokohama (JP); Atsushi Takahashi, Tama (JP); Yoshinori Nakagawa, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/693,260

(22) Filed: Mar. 11, 2022

(65) Prior Publication Data

US 2022/0194108 A1 Jun. 23, 2022

Related U.S. Application Data

(63) Continuation of application No. 16/859,117, filed on Apr. 27, 2020, now Pat. No. 11,305,566, which is a (Continued)

(30) Foreign Application Priority Data

Jul. 7, 2017 (JP) ..... 2017-133530

(51) Int. Cl.
*B41J 29/38* (2006.01)
*B41J 29/17* (2006.01)
(Continued)

(52) U.S. Cl.
CPC ..... *B41J 29/17* (2013.01); *B41J 2/16508* (2013.01); *B41J 2/16526* (2013.01);
(Continued)

(58) Field of Classification Search
CPC ..... B41J 2/18; B41J 2/16538; B41J 29/17
See application file for complete search history.

(56) References Cited

U.S. PATENT DOCUMENTS 5,894,313 A 4/1999 Mabuchi ..... 347/7
7,650,850 B2 1/2010 Iwasaki et al. ..... 118/300
(Continued)

FOREIGN PATENT DOCUMENTS

CN 1872557 12/2006
CN 102343715 2/2012
(Continued)

OTHER PUBLICATIONS

Office Action dated Apr. 15, 2020 in counterpart Chinese Application No. 201810738737.1.
(Continued)

*Primary Examiner* — Lam S Nguyen
(74) *Attorney, Agent, or Firm* — Venable LLP

(57) ABSTRACT

To normally perform a preliminary ejection after a cleaning process. Provided is a recording apparatus including: a recording head that includes an ejection component that ejects a liquid; a circulation unit configured to perform a circulation operation of circulating the liquid in a circulation route including the recording head; a cleaning mechanism that performs a cleaning process with respect to the recording head; and a preliminary ejection unit configured to perform a preliminary ejection operation of preliminarily ejecting the liquid from the ejection component. The cleaning mechanism performs the cleaning process in a state in which circulation of the liquid is stopped, and at least one of the circulation operation by the circulation unit and the preliminary ejection operation by the preliminary ejection unit is performed after the cleaning process.

23 Claims, 22 Drawing Sheets

Related U.S. Application Data continuation of application No. 16/021,116, filed on Jun. 28, 2018, now Pat. No. 10,675,898.

(51) Int. Cl.
*B41J 2/18* (2006.01)
*B41J 2/165* (2006.01)

(52) U.S. Cl.
CPC ..... *B41J 2/16532* (2013.01); *B41J 2/16535* (2013.01); *B41J 2/16538* (2013.01); *B41J 2/16588* (2013.01); *B41J 2/18* (2013.01); *B41J 2002/16573* (2013.01)

(56) References Cited

U.S. PATENT DOCUMENTS

| | | | | |
|---|---|---|---|---|
| 8,726,834 | B2 | 5/2014 | Nakagawa et al. | 118/692 |
| 10,543,680 | B2 | 1/2020 | Fukasawa et al. | B41J 2/18 |
| 10,654,265 | B2 | 5/2020 | Fukasawa et al. | B41J 2/04573 |
| 2006/0268050 | A1 | 11/2006 | Sonobe | 347/29 |
| 2007/0291086 | A1 | 12/2007 | Murakami et al. | 347/85 |
| 2008/0024537 | A1 | 1/2008 | Park | 347/14 |
| 2008/0316237 | A1 | 12/2008 | Jeon | 347/9 |
| 2010/0321425 | A1 | 12/2010 | Kanke et al. | 347/6 |
| 2012/0026220 | A1 | 2/2012 | Igarashi | 347/6 |
| 2013/0257941 | A1 | 10/2013 | Murata et al. | 347/9 |
| 2018/0001623 | A1 | 1/2018 | Nakano et al. | B41J 2/195 |
| 2019/0001670 | A1 | 1/2019 | Fukasawa et al. | B41J 2/18 |
| 2019/0009522 | A1 | 1/2019 | Fukasawa et al. | B41J 2/16535 |

FOREIGN PATENT DOCUMENTS

| | | |
|---|---|---|
| JP | 2005-225183 | 8/2005 |
| JP | 2011-005672 | 1/2011 |
| JP | 2014-024210 | 2/2014 |
| KR | 10-2008-0112749 | 12/2008 |

OTHER PUBLICATIONS

Office Action dated Apr. 16, 2019 in counterpart Japanese Application No. 2017133530.
Office Action dated Oct. 15, 2021 in counterpart Korean Application No. 10-2018-0078594, together with English translation thereof.
Office Action dated Apr. 21, 2021 in counterpart Korean Application No. 10-2018-0078594, together with English translation thereof.
European Search Report dated Dec. 11, 2018 in counterpart European Application No. 18178240.0.

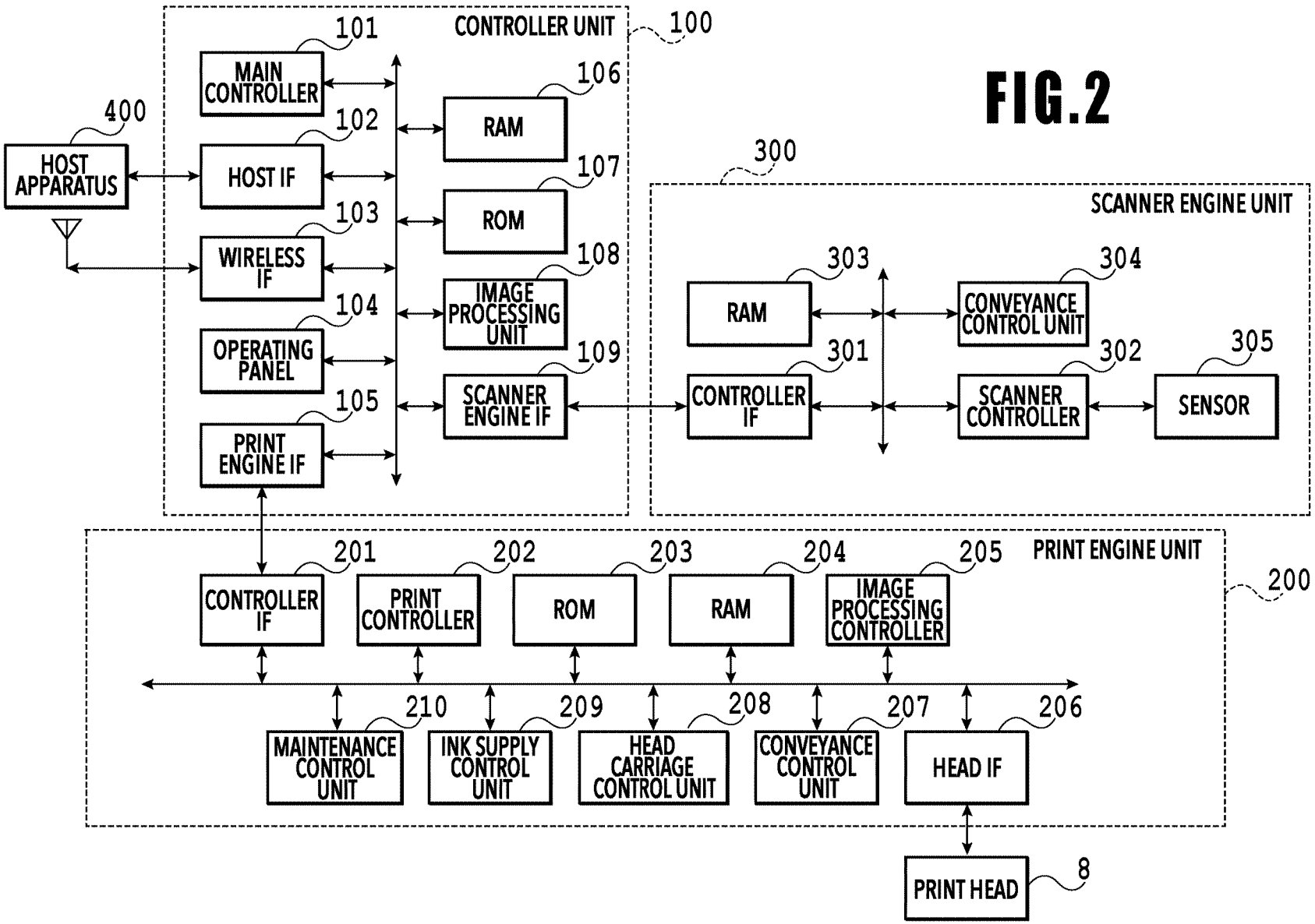
FIG.2
SCANNER ENGINE UNIT
300
305
SENSOR
304
CONVEYANCE CONTROL UNIT
302
SCANNER CONTROLLER
303
RAM
301
CONTROLLER IF
100
CONTROLLER UNIT
106
RAM
107
ROM
108
IMAGE PROCESSING UNIT
109
SCANNER ENGINE IF
101
MAIN CONTROLLER
102
HOST IF
103
WIRELESS IF
104
OPERATING PANEL
105
PRINT ENGINE IF
400
HOST APPARATUS
200
PRINT ENGINE UNIT
205
IMAGE PROCESSING CONTROLLER
204
RAM
203
ROM
202
PRINT CONTROLLER
201
CONTROLLER IF
206
HEAD IF
207
CONVEYANCE CONTROL UNIT
208
HEAD CARRIAGE CONTROL UNIT
209
INK SUPPLY CONTROL UNIT
210
MAINTENANCE CONTROL UNIT
8
PRINT HEAD

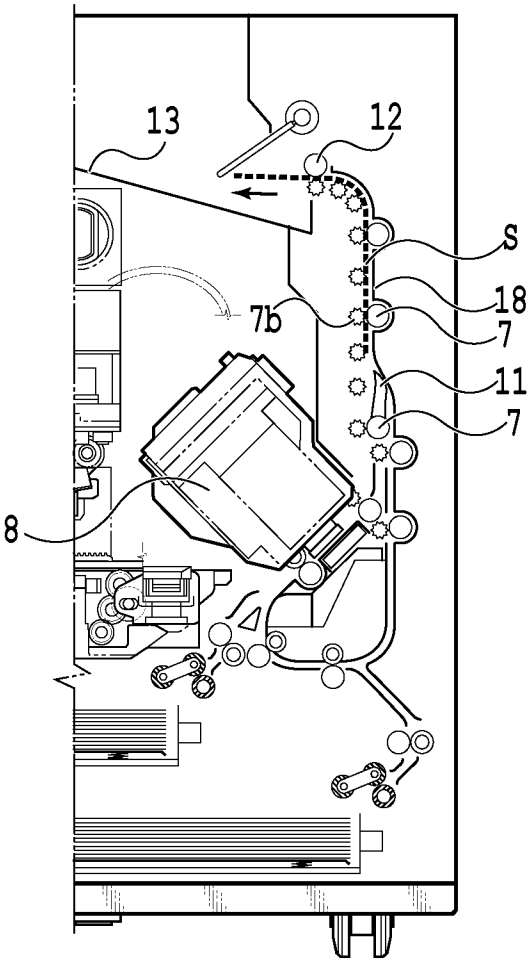
FIG.4C
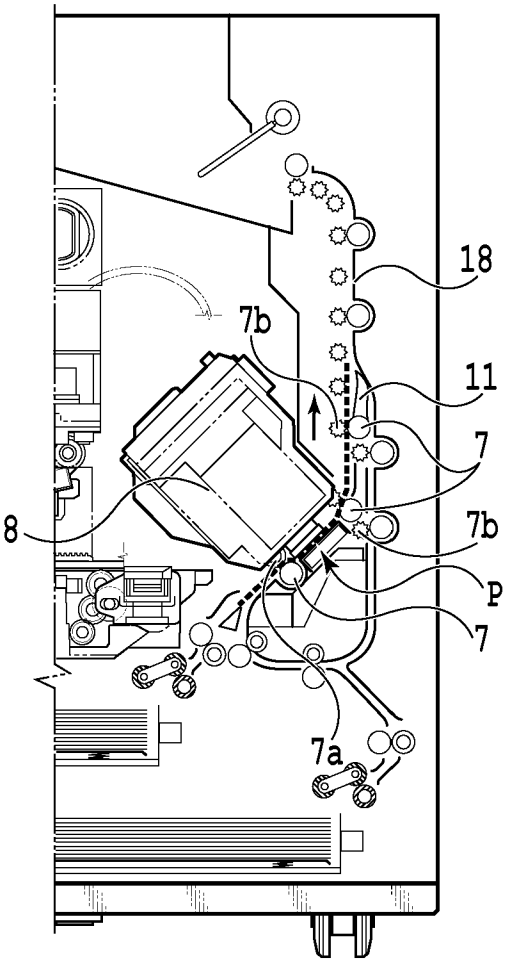
FIG.4B
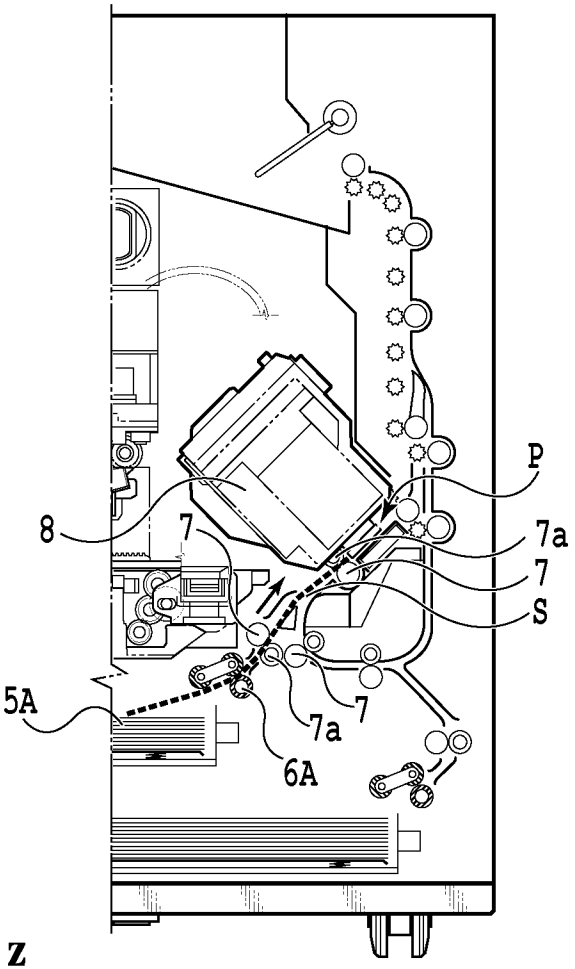
FIG.4A
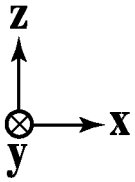

TEMPERATURE AND HUMIDITY STATE

| | FIRST TEMPERATURE AND HUMIDITY STATE | SECOND TEMPERATURE AND HUMIDITY STATE | THIRD TEMPERATURE AND HUMIDITY STATE |
|---|---|---|---|
| EQUAL TO OR MORE THAN 0.080 AND LESS THAN 0.084 | × | × | ○ |
| EQUAL TO OR MORE THAN 0.084 AND LESS THAN 0.089 | × | ○ | ○ |
| 0.089 OR MORE | ○ | ○ | ○ |

| CAPPING TIME | BLACK INK | COLOR INK |
|---|---|---|
| EQUAL TO OR LONGER THAN 0 HOUR AND SHORTER THAN 48 HOURS | CIRCULATION | – |
| EQUAL TO OR LONGER THAN 48 HOURS AND SHORTER THAN 120 HOURS | CIRCULATION + 50 TIMES | 250 TIMES |
| EQUAL TO OR LONGER THAN 120 HOURS AND SHORTER THAN 240 HOURS | CIRCULATION + 100 TIMES | 500 TIMES |
| EQUAL TO OR LONGER THAN 240 HOURS AND SHORTER THAN 720 HOURS | CIRCULATION + 150 TIMES | 750 TIMES |
| 720 HOURS OR LONGER | CIRCULATION + 200 TIMES | 1000 TIMES |

FIG.20

RECORDING APPARATUS, CONTROL METHOD, AND STORAGE MEDIUM

CROSS-REFERENCE TO RELATED APPLICATIONS

This application is a continuation of U.S. patent application Ser. No. 16/859,117 filed Apr. 27, 2020, currently pending, which was a continuation of U.S. patent application Ser. No. 16/021,116 filed Jun. 28, 2018, now issued as U.S. Pat. No. 10,675,898 on Jun. 9, 2020; and claims benefit from Japan Application No. 2017-133530 filed in Japan on Jul. 7, 2017; the contents of all of which are incorporated herein in their entirety.

BACKGROUND OF THE INVENTION

Field of the Invention

The present invention relates to a recording apparatus, a control method, and a storage medium.

Description of the Related Art

Japanese Patent Laid-Open No. 2014-24210 discloses a configuration in which preliminary ejection is performed after wiping an ejection port surface of a recording head of an inkjet recording apparatus.

SUMMARY OF THE INVENTION

However, there is a concern that concentration of ink that is in contact with the external air within the ejection port proceeds during wiping, and thus normal ejection may not be performed in the preliminary ejection after wiping. However, Japanese Patent Laid-Open No. 2014-24210 does not consider the above-described problem.

The present invention has been made in consideration of the above-described problem, and an object thereof is to provide a configuration capable of normally performing preliminary ejection after cleaning such as wiping.

According to an aspect of the invention, there is provided a recording apparatus including: a tank in which a liquid is stored;

a recording head that includes an ejection component that ejects the liquid supplied from the tank; a circulation unit configured to perform a circulation operation of circulating the liquid in a circulation route including the tank and the recording head;

a cleaning mechanism that is in contact with the ejection component and performs a cleaning operation; a preliminary ejection unit configured to perform a preliminary ejection operation of preliminarily ejecting the liquid from the ejection component; and a control unit configured to control to perform at least one of the circulation operation and the preliminary ejection operation after the cleaning mechanism performs the cleaning operation in a state in which the circulation operation is stopped.

Further features of the present invention will become apparent from the following description of exemplary embodiments with reference to the attached drawings.

BRIEF DESCRIPTION OF THE DRAWINGS

FIG. 2 is a block diagram illustrating a control configuration of the recording apparatus;

FIGS. 4A to 4C are views of a conveying route of a recoding medium that is fed from a first cassette;

FIG. 20 is a table that is used in a seventh embodiment; and

DESCRIPTION OF THE EMBODIMENTS

Hereinafter, description will be given of a liquid ejection head and a liquid ejection apparatus according to embodiments of the invention with reference to the accompanying drawings. In the following embodiments, description will be given of a specific configuration of the inkjet recording head that ejects ink and the inkjet recording apparatus, but the invention is not limited thereto. The liquid ejection head, the liquid ejection apparatus, and a liquid supply method according to the invention are also applicable to apparatuses such as a printer, a copying machine, a facsimile including a communication system, and word processor including a printer unit, and an industrial recording apparatus that is combined with various processing apparatuses in a composite manner. For example, the liquid ejection head and the liquid ejection apparatus, and the liquid supply method can also be used for manufacturing of a biochip, electronic circuit printing, and the like. In addition, the following embodiments are specific examples of the invention, and thus technically preferred various limitations are given thereto. However, embodiments are not limited to the following embodiments and other specific methods as long as the embodiments conform to the spirit of the invention.

<With Regard to Internal Configuration of Recording Apparatus>

Figure 1:
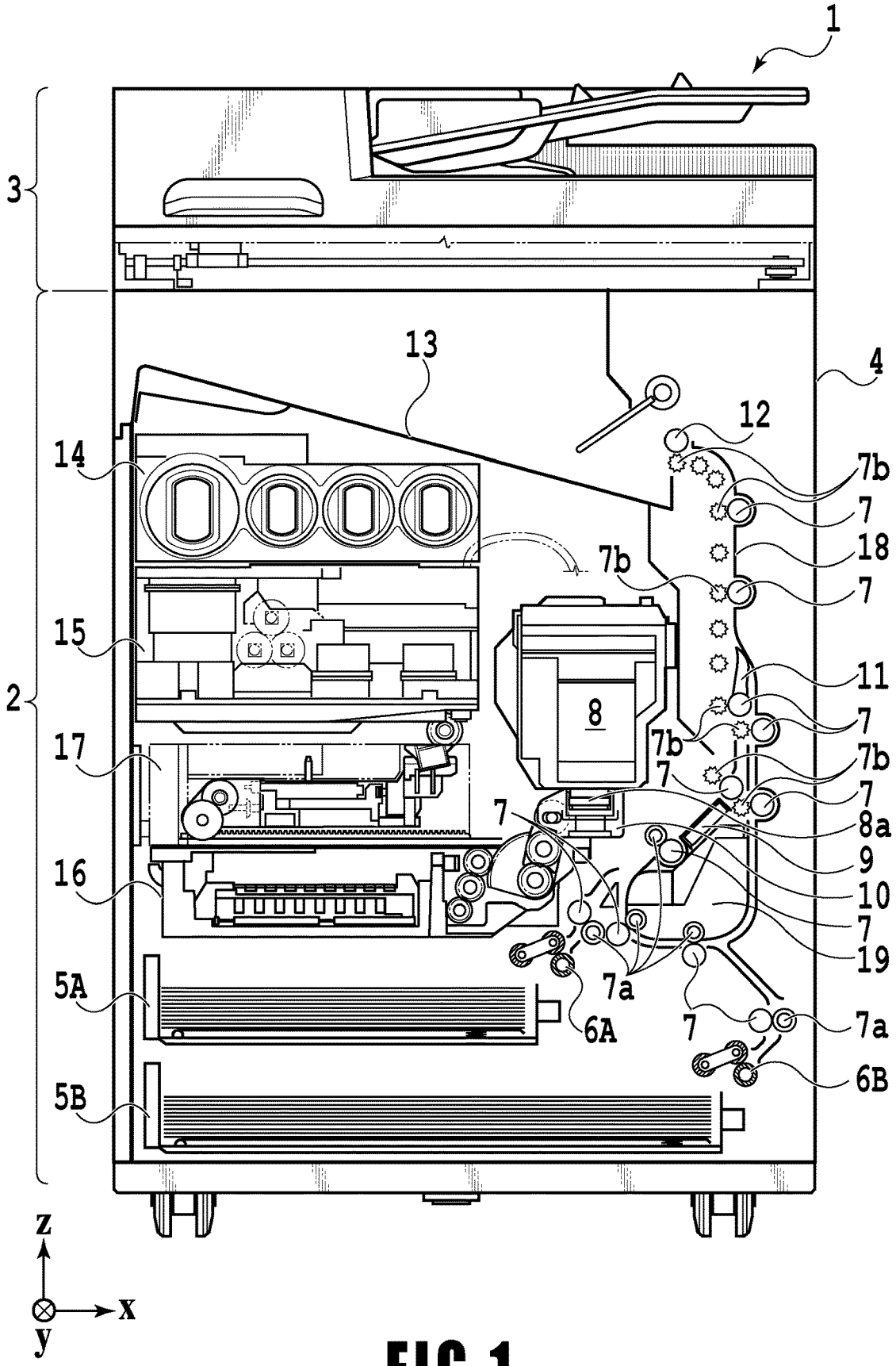
FIG. 1 is a view illustrating a stand-by state of a recording apparatus.

FIG. 1 is an internal configuration view of an inkjet recording apparatus 1 (hereinafter, referred to as a recording apparatus 1). In the drawing, an x direction represents a horizontal direction, a y direction (a direction perpendicular to a paper plane) represents a direction in which ejection ports are arranged in a recording head 8 to be described later, and a z direction represents a vertical direction.

The recording apparatus 1 is a multifunctional machine including a print unit 2 and a scanner unit 3, and can execute various processes relating to a recording operation and a reading operation by the print unit 2 and the scanner unit 3 in an individual manner or in synchronization with each other. The scanner unit 3 includes an auto document feeder (ADF) and a flatbed scanner (FBS), and can perform reading of an original document that is automatically fed by the ADF, and reading (scanning) of an original document that is placed on a document platen of the FBS by a user. Furthermore, here, the multifunctional machine including the print unit 2 and the scanner unit 3 is illustrated, but an aspect not provided with the scanner unit 3 is also possible. FIG. 1 illustrates a stand-by state in which the recording apparatus 1 does not perform the recording operation and the reading operation.

In the print unit 2, at a lower portion of a housing 4 in a vertically downward direction, a first cassette 5A and a second cassette 5B which accommodate a recording medium (cut sheet) S are detachably provided. A relatively small recording medium up to an A4 size is accommodated in the first cassette 5A in a stacked manner, and a relatively large recording medium up to an A3 size is accommodated in the second cassette 5B in a stacked manner. A first feeding unit 6A that separates and feeds the recording medium accommodated sheet by sheet is provided in the vicinity of the first cassette 5A. Similarly, a second feeding unit 6B is provided in the vicinity of the second cassette 5B. When the recording operation is performed, a recording medium S is selectively fed from any one cassette.

A conveying roller 7, an ejection roller 12, a pinch roller 7*a*, a spur 7*b*, a guide 18, an inner guide 19, and a flapper 11 constitute a conveying mechanism that guides the recording medium S in a predetermined direction. The conveying roller 7 is a drive roller that is disposed upstream and downstream of the recording head 8, and is driven by a conveying motor that is not illustrated in the drawing. The pinch roller 7*a* is a driven roller that rotates by nipping the recording medium S in combination with the conveying roller 7. The ejection roller 12 is a drive roller that is disposed downstream of the conveying roller 7 and is driven by the conveying motor that is not illustrated in the drawing. The spur 7*b* conveys the recording medium S by nipping the recording medium S in combination with the conveying roller 7 and the ejection roller 12 which are disposed downstream of the recording head 8.

The guide 18 is provided on a conveying route of the recording medium S, and guides the recording medium S in a predetermined direction. The inner guide 19 is a member that extends in the y direction, has a curved lateral surface, and guides the recording medium S along the lateral surface. The flapper 11 is a member that switches a direction in which the recording medium S is conveyed in a double-side recording operation. An ejection tray 13 is a tray on which the recording medium S, for which the recording operation is completed and which is ejected by the ejection roller 12, is stacked and retained.

The recording head 8 is a full-line type color inkjet recording head, and includes a plurality of ejection ports from which ink is ejected according to recording data, and which are arranged in correspondence with a width of the recording medium S along the y direction in FIG. 1. When the recording head 8 is in a stand-by position, an ejection port surface 8*a* of the recording head 8 is capped with a cap unit 10 in a vertically downward direction as illustrated in FIG. 1. When performing the recording operation, a direction of the recording head 8 is changed so that the ejection port surface 8*a* faces the platen 9 by a print controller 202 to be described later. The platen 9 is constituted by a flat plate that extends in the y direction, and supports a rear surface of the recording medium S for which the recording operation has been performed by the recording head 8. Movement of the recording head 8 from the stand-by position to a recording position will be described later in detail.

An ink tank unit 14 stores four colors of ink to be supplied to the recording head 8. Here, the four colors of ink represent ink of cyan (C), ink of magenta (M), ink of yellow (Y), and ink of black (K). An ink supply unit 15 is provided in the middle of a flow passage that connects the ink tank unit 14 and the recording head 8, and adjusts a pressure and a flow rate of the ink in the recording head 8 in an appropriate range. The recording apparatus 1 includes a circulation-type ink supply system, and the ink supply unit 15 adjusts a pressure of ink that is supplied to the recording head 8 and a flow rate of ink that is recovered from the recording head 8 in an appropriate range.

A maintenance unit 16 includes a cap unit 10 and a wiping unit 17, and operates these units at a predetermined timing to perform a maintenance operation with respect to the recording head 8. The maintenance operation will be described later in detail.

<With Regard to Control Configuration of Recording Apparatus>

FIG. 2 is a block diagram illustrating a control configuration in the recording apparatus 1. The recording apparatus 1 includes a print engine unit 200 that mainly integrally controls the print unit 2, a scanner engine unit 300 that integrally controls the scanner unit 3, and a controller unit 100 that integrally controls the entirety of the recording apparatus 1. A print controller 202 controls various mechanisms of the print engine unit 200 in accordance with an instruction of a main controller 101 of the controller unit 100. Various mechanisms of the scanner engine unit 300 are controlled by the main controller 101 of the controller unit 100. Hereinafter, details of the control configuration will be described.

In the controller unit 100, the main controller 101 that is constituted by a CPU controls the entirety of the recording apparatus 1 with a RAM 106 set as a work area in accordance with a program or various parameters which are stored in a ROM 107. For example, in a case where a print job is input from a host device 400 through a host I/F 102 or a wireless I/F 103, predetermined image processing is performed with respect to image data that is received by an image processing unit 108 in accordance with an instruction of the main controller 101. In addition, the main controller 101 transmits the image data subjected to the image processing to the print engine unit 200 through a print engine I/F 105.

Furthermore, the recording apparatus 1 may acquire image data from the host device 400 through wireless communication or wired communication, or may acquire image data from an external storage device (USB memory, and the like) that is connected to the recording apparatus 1. A communication type that is used in the wired communication or the wireless communication is not limited. For example, as a communication type that is used in the wireless communication, wireless fidelity (Wi-Fi) (registered trademark) or Bluetooth (registered trademark) are applicable. In addition, as a communication type that is used in the wired communication, a universal serial bus (USB), and the like are applicable. In addition, for example, when a reading command is input from the host device 400, the main controller 101 transmits the command to the scanner engine unit 300 through a scanner engine I/F 109.

An operation panel 104 is a mechanism that performs input and output with respect to the recording apparatus 1 by a user. The user can give an instruction for an operation such as copying and scanning, can set a print mode, or recognize information of the recording apparatus 1 through the operation panel 104.

In the print engine unit 200, the print controller 202 that is constituted by a CPU controls various mechanisms provided in the print unit 2 with a RAM 204 set as a work area in accordance with a program or various parameters which are stored in a ROM 203. When various commands or image data is received through a controller I/F 201, the print controller 202 stores the commands or the image data in the RAM 204 at once. The print controller 202 converts the image data that is stored into recording data by an image processing controller 205 in order for the recording head 8 to use the recording data in a recording operation. When the recording data is generated, the print controller 202 allows the recording head 8 to execute a recording operation based on the recording data through a head I/F 206. At this time, the print controller 202 drives the feeding units 6A and 6B, the conveying roller 7, the ejection roller 12, and the flapper 11 as illustrated in FIG. 1 through a conveyance control unit 207 to convey the recording medium S. In accordance with an instruction of the print controller 202, a recording operation by the recording head 8 is executed in synchronization with the conveying operation of the recording medium S, and thus printing is performed.

A head carriage control unit 208 changes a direction or a position of the recording head 8 in correspondence with an operation state such as a maintenance state or a recording state of the recording apparatus 1. An ink supply control unit 209 controls the ink supply unit 15 so that a pressure of ink supplied to the recording head 8 is within an appropriate range. When a maintenance operation for the recording head 8 is performed, a maintenance control unit 210 controls an operation of a cleaning mechanism such as the cap unit 10 and the wiping unit 17 in the maintenance unit 16.

In the scanner engine unit 300, the main controller 101 controls a hardware resource of a scanner controller 302 with the RAM 106 set as a work area in accordance with a program or various parameters which are stored in the ROM 107. According to this, various mechanisms provided in the scanner unit 3 are controlled. For example, the main controller 101 controls the hardware resource in the scanner controller 302 through a controller I/F 301 to convey an original document mounted on the ADF by a user through a conveyance control unit 304, and to read the original document by a sensor 305. In addition, the scanner controller 302 stores image data that is read in a RAM 303. Furthermore, the print controller 202 converts the image data acquired as described above into recording data, and can allow the recording head 8 to execute a recording operation based on the image data that is read by the scanner controller 302.

<With Regard to Operation of Recording Apparatus in Recording State>

Figure 3:
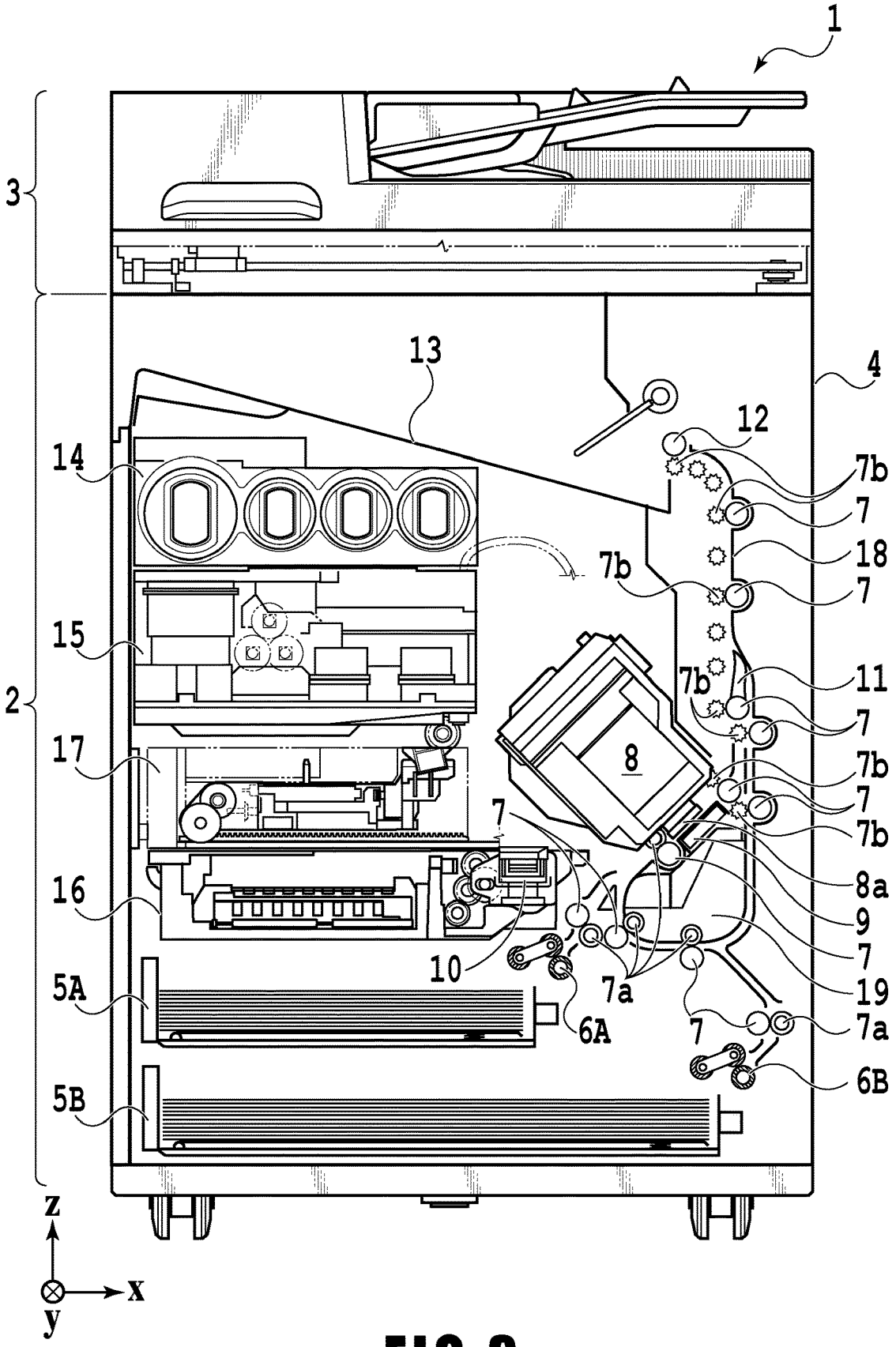
FIG. 3 is a view illustrating a recording state of the recording apparatus.

FIG. 3 illustrates a recording state of the recording apparatus 1. In the case of comparing the recording state with the stand-by state illustrated in FIG. 1, the cap unit 10 is spaced away from the ejection port surface 8*a* of the recording head 8, and the ejection port surface 8*a* faces the platen 9. A flat surface of the platen 9 is inclined at an angle of approximately 45° with respect to a horizontal direction, and the ejection port surface 8*a* of the recording head 8 at a recording position is also inclined at an angle of approximately 45° with respect to the horizontal direction in order for a distance from the platen 9 to be constantly maintained.

When moving the recording head 8 from the stand-by position illustrated in FIG. 1 to the recording position illustrated in FIG. 3, the print controller 202 lowers the cap unit 10 to a retreated position illustrated in FIG. 3 by using the maintenance control unit 210. According to this, the ejection port surface 8*a* of the recording head 8 is spaced away from the cap member 10*a*. Then, the print controller 202 rotates the recording head 8 by 45° while adjusting the height of the recording head 8 in the vertical direction by using the head carriage control unit 208, and thus the ejection port surface 8*a* faces the platen 9. When the recording operation is completed, and the recording head 8 moves from the recording position to the stand-by position, a process opposite to the above-described process is performed by the print controller 202.

Next, description will be given of a conveying route of the recording medium S in the print unit 2. When a recording command is input, first, the print controller 202 moves the recording head 8 to the recording position illustrated in FIG. 3 by using the maintenance control unit 210 and the head carriage control unit 208. Then, the print controller 202 drives any one of the first feeding unit 6A and the second feeding unit 6B in accordance with the recording command by using the conveyance control unit 207 to feed the recording medium S.

FIGS. 4A to 4C are views illustrating a conveying route when feeding the recording medium S having the A4 size which is accommodated in the first cassette 5A. The recording medium S that is stacked on the uppermost side in the first cassette 5A is separated from a second or later recording medium by the first feeding unit 6A, and is conveyed toward a recording region P between the platen 9 and the recording head 8 while being nipped by the conveying roller 7 and the pinch roller 7*a*. FIG. 4A illustrates a conveying state immediately before a front end of the recording medium S reaches the recording region P. A proceeding direction of the recording medium S is changed from the horizontal direction (x direction) to a direction that in inclined by approximately 45° with respect to the horizontal direction when being fed by the first feeding unit 6A and reaching the recording region P.

In the recording region P, ink is ejected from a plurality of ejection ports provided in the recording head 8 toward the recording medium S. A rear surface of the recording medium S in a region, to which ink is applied, is supported by the platen 9, and a distance between the ejection port surface 8*a* and the recording medium S is constantly maintained. The recording medium S after application of ink passes through a left side of the flapper 11, of which a front end is inclined to a right side, while being guided by the conveying roller 7 and the spur 7*b*, and conveyed to a vertically upward side of the recording apparatus 1 along the guide 18. FIG. 4B illustrates a state in which the front end of the recording medium S passes through the recording region P and is conveyed to the vertically upper side. A proceeding direction of the recording medium S is changed from the position of the recording region P that is inclined by approximately 45° with respect to the horizontal direction to the vertically upward side by the conveying roller 7 and the spur 7*b*.

After being conveyed to the vertically upward side, the recording medium S is ejected to the ejection tray 13 by the ejection roller 12 and the spur 7*b*. FIG. 4C illustrates a state in which the front end of the recording medium S passes through the ejection roller 12 and is ejected to the ejection tray 13. The recording medium S that is ejected is retained on the ejection tray 13 in a state in which a surface on which an image is recorded by the recording head 8 faces a lower side.

Figure 5C:
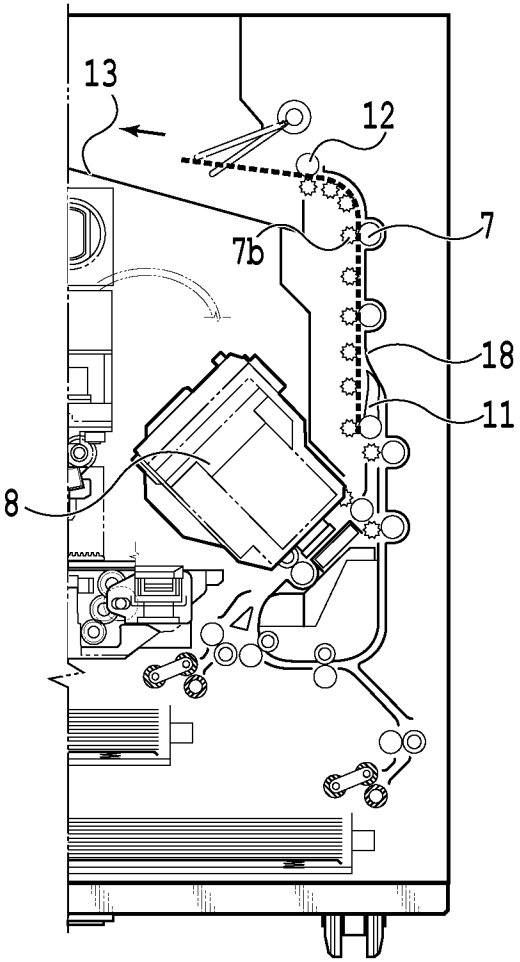
FIGS. 5A to 5C are views of a conveying route of a recording medium that is fed from a second cassette.
Figure 5B:
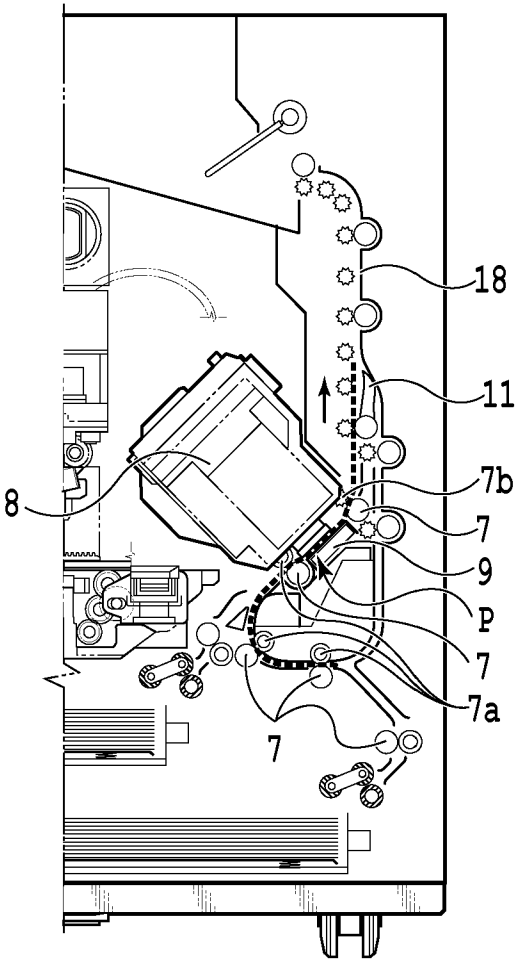
Figure 5A:
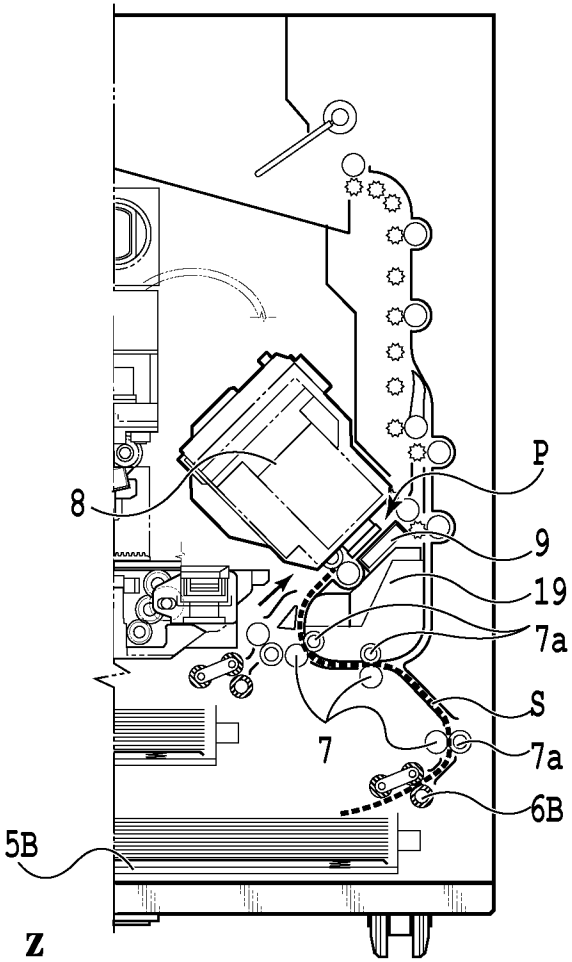

FIGS. 5A to 5C are views illustrating a conveying route when feeding the recording medium S having the A3 size which is accommodated in the second cassette 5B. The recording medium S that is stacked on the uppermost side in the second cassette 5B is separated from a second or later recording medium by the second feeding unit 6B, and is conveyed toward the recording region P between the platen 9 and the recording head 8 while being nipped by the conveying roller 7 and the pinch roller 7*a*.

FIG. 5A illustrates a conveying state immediately before a front end of the recording medium S reaches the recording region P. In a conveying route until reaching the recording region P after being fed by the second feeding unit 6B, a plurality of the conveying roller 7, a plurality of the pinch roller 7*a*, and the inner guide 19 are disposed, and thus the recording medium S is conveyed to the platen 9 in a state of being curved in an S-shaped.

The subsequent conveying route is the same as in the case of the recording medium S having the A4 size as illustrated in FIGS. 4B and 4C. FIG. 5B illustrates a state in which the front end of the recording medium S passes through the recording region P and is conveyed to a vertically upward side. FIG. 5C illustrates a state in which the front end of the recording medium S passes through the ejection roller 12, and is ejected to the ejection tray 13.

FIGS. 6A to 6D illustrate a conveying route in a case where a recording operation (double-sided recording) is performed with respect to a rear surface (second surface) of the recording medium S having the A4 size. In the case of performing the double-sided recording, after recording is performed on the first surface (front surface), the recording operation is performed with respect to the second surface (rear surface). A conveying process when performing recording on the first surface is the same as in FIGS. 4A to 4C, and thus description thereof will be omitted. Hereinafter, description will be given of a conveying process subsequent to FIG. 4C.

Figures 6A, 6B, 6C, 6D:
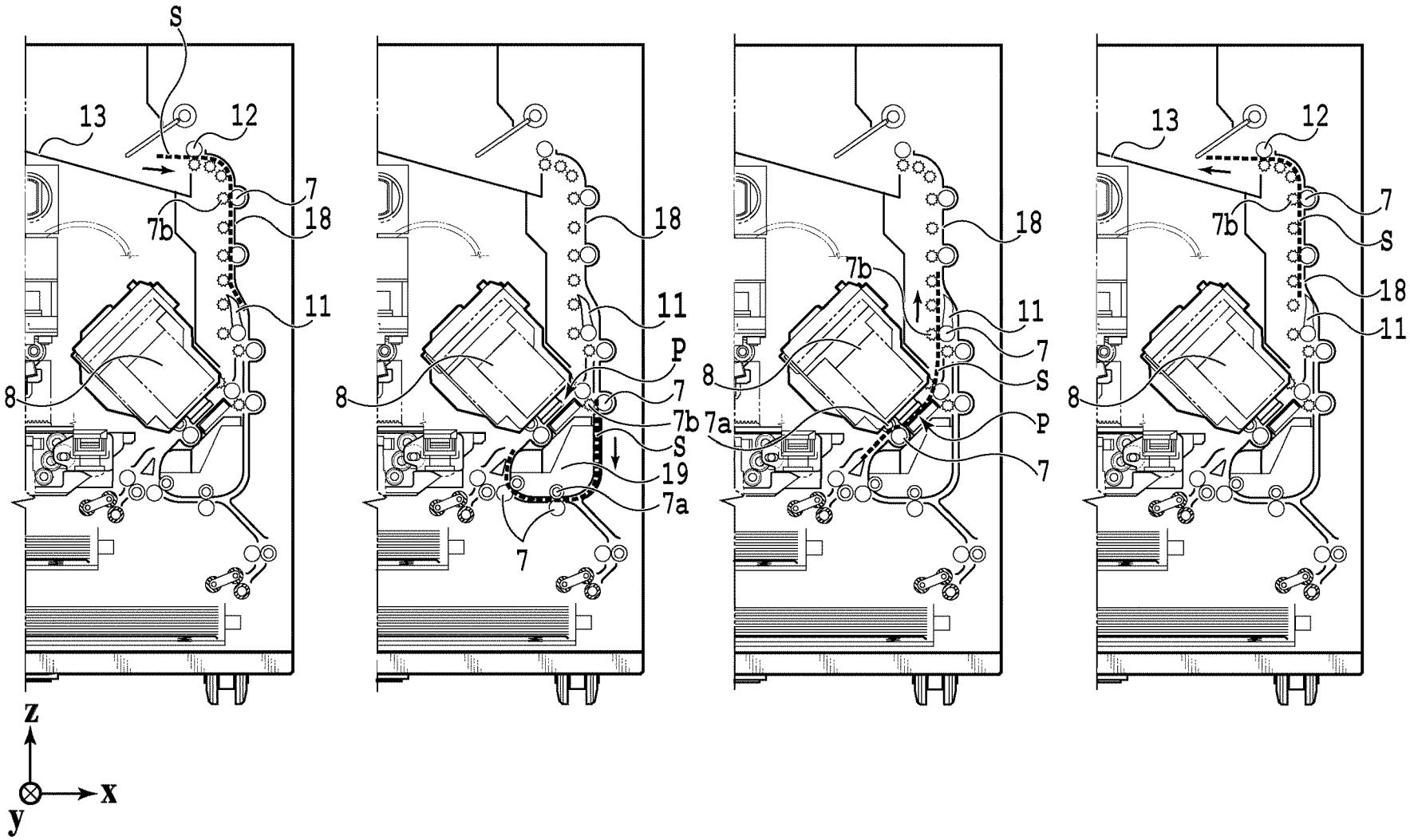
FIGS. 6A to 6D are views of a conveying route of a recording medium in a case where a recording operation is performed with respect to a rear surface of the recording medium.

When the recording operation on the first surface by the recording head 8 is completed, and a rear end of the recording medium S passes through the flapper 11, the print controller 202 inversely rotates the conveying roller 7 to convey the recording medium S to the inside of the recording apparatus 1. At this time, the flapper 11 is controlled so that a tip end thereof is inclined to a left side by an actuator (not illustrated in the drawings), and thus the front end (the rear end in the recording operation on the first surface) of the recording medium S passes through a right side of the flapper 11, and is conveyed to a vertically downward side. FIG. 6A illustrates a state in which the front end (the rear end in the recording operation on the first surface) of the recording medium S passes through a right side of the flapper 11.

Then, the recording medium S is conveyed along a curved outer peripheral surface of the inner guide 19, and is conveyed again to the recording region P between the recording head 8 and the platen 9. At this time, the second surface of the recording medium S faces the ejection port surface 8*a* of the recording head 8. FIG. 6B illustrates a conveying state immediately before the front end of the recording medium S reaches the recording region P for the recording operation of the second surface.

The subsequent conveying route is the same as in the case of performing recording on the first surface as illustrated in FIGS. 4B and 4C. FIG. 6C illustrates a state in which the front end of the recording medium S passes through the recording region P and is conveyed to a vertically upward side. At this time, the flapper 11 is controlled so that the tip end thereof is moved to a position that is inclined to a right side by an actuator (not illustrated). FIG. 6D illustrates a state in which the front end of the recording medium S passes through the ejection roller 12 and is ejected to the ejection tray 13.

<With Regard to Maintenance Operation With Respect to Recording Head>

Next, description will be given of a maintenance operation with respect to the recording head 8. As illustrated in FIG. 1, the maintenance unit 16 includes the cap unit 10 and the wiping unit 17, and operates these units at a predetermined timing to perform the maintenance operation.

Figure 7:
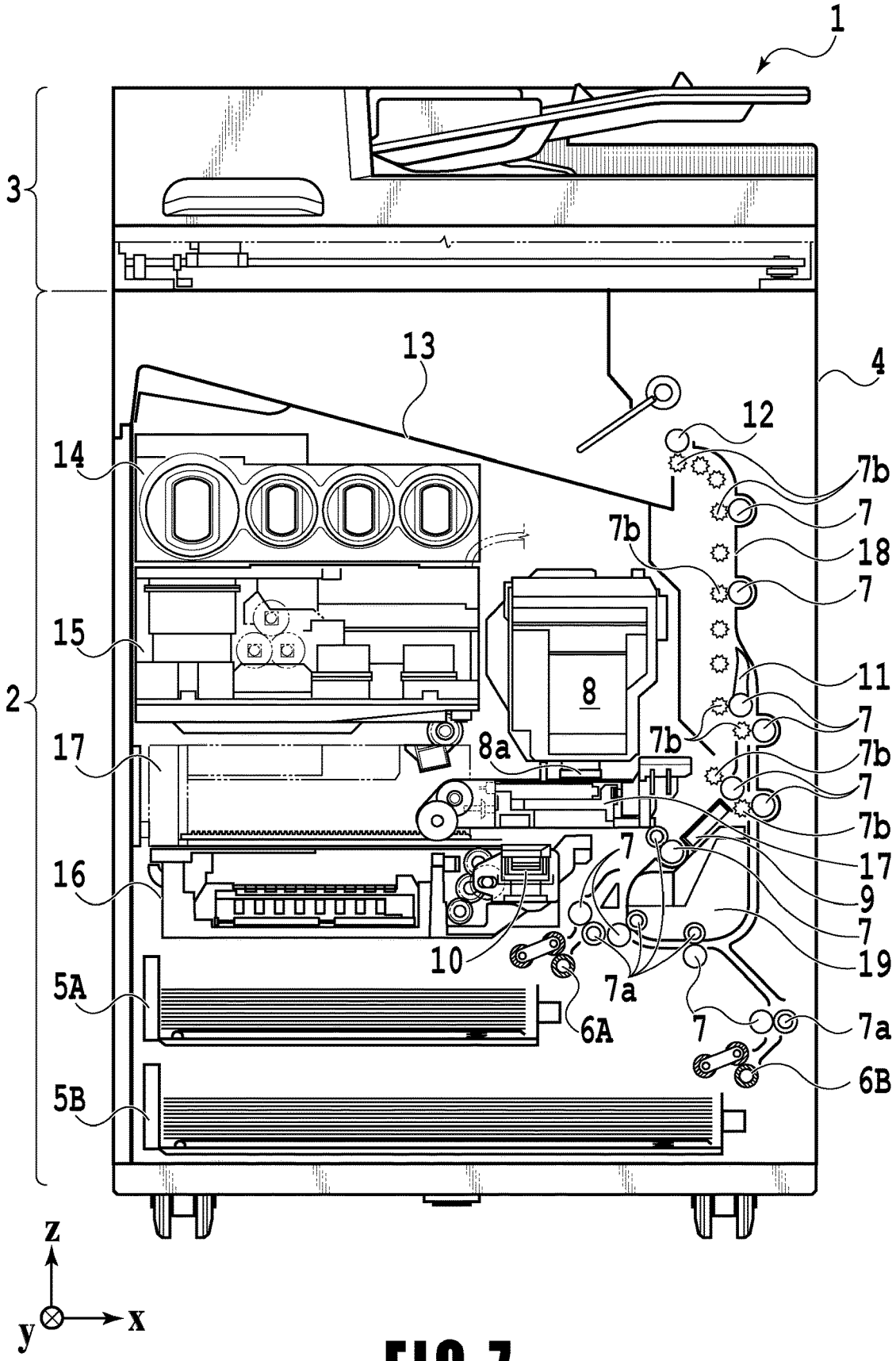
FIG. 7 is a view illustrating a maintenance state of the recording apparatus.

FIG. 7 is a view illustrating a maintenance state of the recording apparatus 1. When moving the recording head 8 from the stand-by position illustrated in FIG. 1 to a maintenance position illustrated in FIG. 7, the print controller 202 moves the recording head 8 to a vertically upward side, and moves the cap unit 10 to a vertically downward side. In addition, the print controller 202 moves the wiping unit 17 from a retreated position toward a right direction in FIG. 7. Then, the print controller 202 moves the recording head 8 to a vertically downward side up to a maintenance position at which the maintenance operation can be performed.

On the other hand, when moving the recording head 8 from the recording position illustrated in FIG. 3 to the maintenance position illustrated in FIG. 7, the print controller 202 moves the recording head 8 to a vertically upward side while rotating the recording head 8 by 45°. In addition, the print controller 202 moves the wiping unit 17 from the retreated position toward a right direction. Then, the print controller 202 moves the recording head 8 to a vertically downward side up to the maintenance position at which the maintenance operation by the maintenance unit 16 can be performed.

Figure 8A:
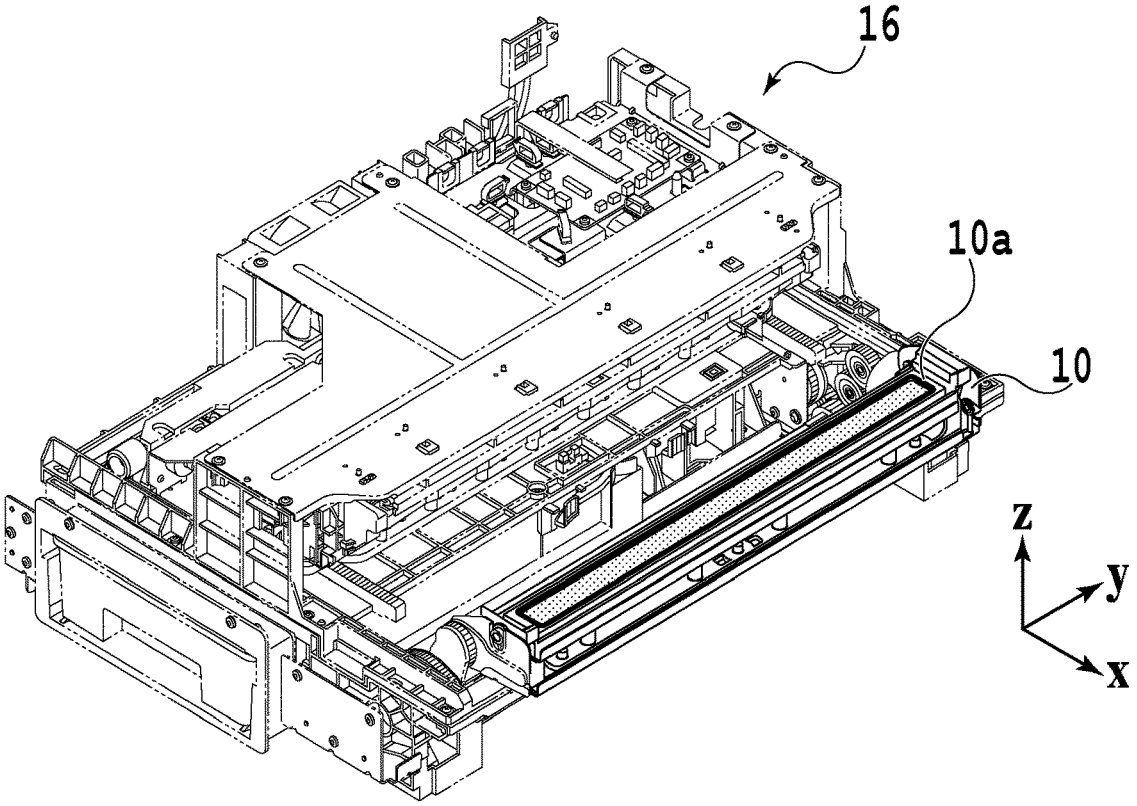
FIGS. 8A and 8B are perspective views illustrating a configuration of a maintenance unit.
Figure 8B:
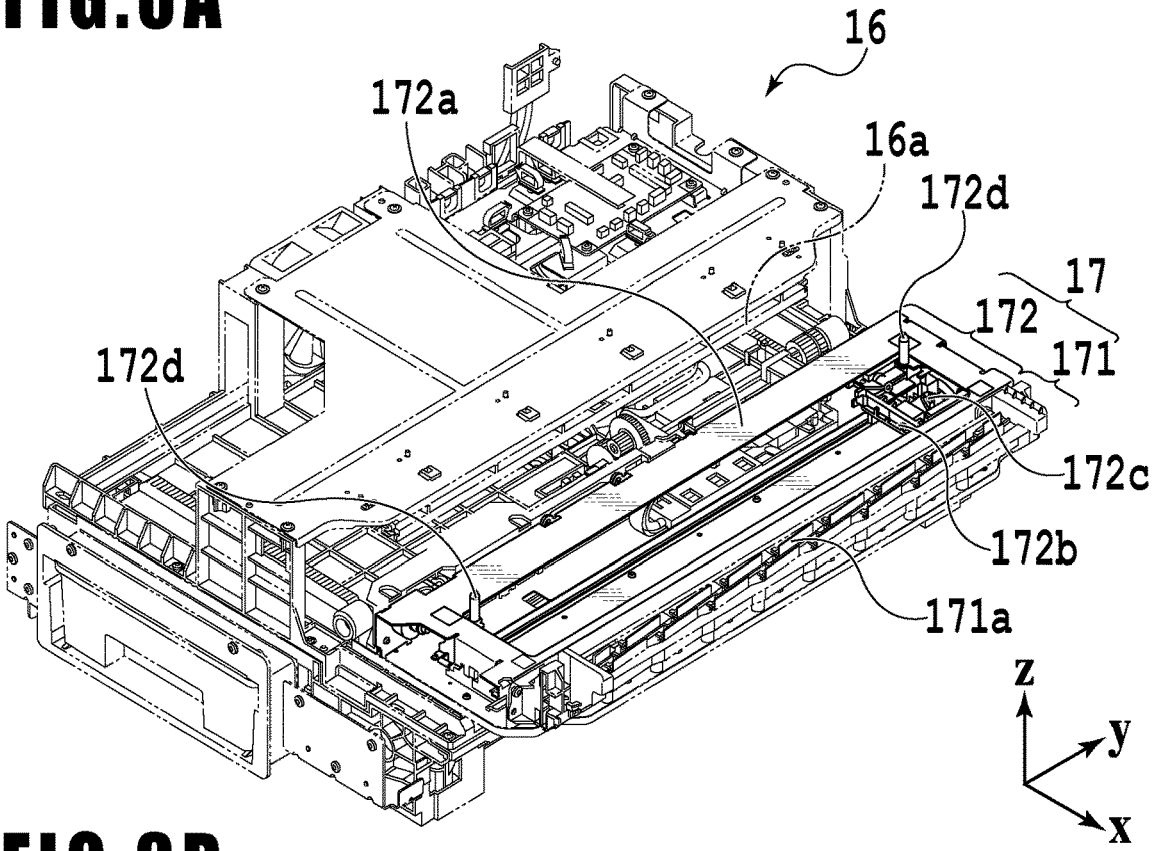

FIG. 8A is a perspective view illustrating a state in which the maintenance unit 16 is located at a stand-by position, and FIG. 8B is a perspective view illustrating a state in which the maintenance unit 16 is located at a maintenance position. FIG. 8A corresponds to FIG. 1, and FIG. 8B corresponds to FIG. 7. When the recording head 8 is at the stand-by position, the maintenance unit 16 is located at the stand-by position illustrated in FIG. 8A, the cap unit 10 moves in a vertically upward side, and the wiping unit 17 is accommodated at the inside of the maintenance unit 16. The cap unit 10 includes a box-shaped cap member 10*a* that extends in the y direction, and the cap member 10*a* is brought into close contact with the ejection port surface 8*a* of the recording head 8 to suppress evaporation of ink from the ejection ports. In addition, the cap unit 10 also has a function of recovering ink, which is ejected in preliminary ejection, to the cap member 10*a*, and of suctioning the recovered ink by a suction pump (not illustrated in the drawing) (cap suction).

On the other hand, at the maintenance position illustrated in FIG. 8B, the cap unit 10 moves in a vertically downward side, and the wiping unit 17 is led-out from the maintenance unit 16. The wiping unit 17 includes two wiper units including a blade wiper unit 171 and a vacuum wiper unit 172.

In the blade wiper unit 171, a blade wiper 171*a* that wipes the ejection port surface 8*a* along the x direction is disposed in the y direction in a length corresponding to an arrangement region of the ejection ports. The blade wiper 171*a* wipes ejection port rows corresponding to a plurality colors along the x direction as a whole, which are arranged on the ejection port surface 8*a*. When performing a wiping operation by using the blade wiper unit 171, the wiping unit 17 moves the blade wiper unit 171 in the x direction in a state in which the recording head 8 is positioned to a height at which the recording head 8 can come into contact with the blade wiper 171*a*. Due to the movement, ink and the like which adhere to the ejection port surface 8*a* is wiped off by the blade wiper 171*a*.

A wet wiper cleaner 16*a*, which removes ink adhered to the blade wiper 171*a* and applies a wet solution to the blade wiper 171*a*, is disposed at an inlet of the maintenance unit 16 when the blade wiper 171*a* is accommodated. Whenever being accommodated in the maintenance unit 16, a material adhered to the blade wiper 171*a* is removed by the wet wiper cleaner 16*a*, and the wet solution is applied to the blade wiper 171*a*. In addition, when subsequently wiping the ejection port surface 8*a*, the wet solution is transferred to the ejection port surface 8*a*, and slidability between the ejection port surface 8*a* and the blade wiper 171*a* is improved.

On the other hand, the vacuum wiper unit 172 includes a flat plate 172*a* having an opening that extends in the y direction, a carriage 172*b* that can move at the inside of the opening in the y direction, and a vacuum wiper 172*c* that is mounted on the carriage 172*b*. The vacuum wiper 172*c* is disposed in a manner capable of wiping the ejection port surface 8*a* in the y direction along with movement of the carriage 172*b*. A suction port that is connected to a suction pump (not illustrated in the drawing) is formed at a tip end of the vacuum wiper 172*c*. Accordingly, when moving the carriage 172*b* in the y direction while operating the suction pump, ink and the like which adhere to the ejection port surface 8*a* of the recording head 8 are suctioned into the suction port while being wiped and collected by the vacuum wiper 172*c*. At this time, a positioning pin 172*d* that is provided on both ends of the flat plate 172*a* and the opening is used in alignment of the ejection port surface 8*a* with respect to the vacuum wiper 172*c*.

The wiping unit 17 can perform a first wiping process in which a wiping operation by the blade wiper unit 171 is performed and a wiping operation by the vacuum wiper unit 172 is not performed, and a second wiping process in which both of the wiping processes are sequentially performed. When performing the first wiping process, first, the print controller 202 leads out the wiping unit 17 from the maintenance unit 16 in a state in which the recording head 8 is further retreated to a vertically upward side in comparison to the maintenance position in FIG. 7. In addition, the print controller 202 moves the recording head 8 to a vertically downward side up to a position at which the recording head 8 can come into contact with the blade wiper 171*a*, and then moves the wiping unit 17 into the maintenance unit 16. Due to the movement, ink and the like which adhere to the ejection port surface 8*a* are wiped off by the blade wiper 171*a*. That is, the blade wiper 171*a* wipes the ejection port surface 8*a* when being moved from a lead-out position from the maintenance unit 16 into the maintenance unit 16.

When the blade wiper unit 171 is accommodated, the print controller 202 moves the cap unit 10 to a vertically upward side and brings the cap member 10*a* into close contact with the ejection port surface 8*a* of the recording head 8. In addition, the print controller 202 operates the recording head 8 at this state to perform preliminary ejection, and allows the suction pump to suction ink recovered into the cap member 10*a*.

On the other hand, when performing the second wiping process, first, the print controller 202 leads out the wiping unit 17 from the maintenance unit 16 through sliding in a state in which the recording head 8 is further retreated in a vertically upward side in comparison to the maintenance position in FIG. 7. In addition, the print controller 202 moves the recording head 8 to a vertically downward side up to a position at which the recording head 8 can come into contact with the blade wiper 171*a*, and moves the wiping unit 17 into the maintenance unit 16. According to this, the wiping operation by the blade wiper 171*a* is performed with respect to the ejection port surface 8*a*. Next, the print controller 202 leads out the wiping unit 17 to a predetermined position from the maintenance unit 16 through sliding in a state in which the recording head 8 is further retreated to a vertically upward side in comparison to the maintenance position in FIG. 7. Continuously, the print controller 202 performs positioning of the ejection port surface 8*a* and the vacuum wiper unit 172 by using the flat plate 172*a* and the positioning pin 172*d* while lowering the recording head 8 to a wiping position illustrated in FIG. 7. Then, the print controller 202 executes the wiping operation by the vacuum wiper unit 172. The print controller 202 retreats the recording head 8 to a vertically upward side to accommodate the wiping unit 17, and then performs preliminary ejection into the cap member by the cap unit 10 and a suction operation of ink that is recovered in the same manner as in the first wiping process.

<With Regard to Circulation Type Ink Supply System>

Figure 9:
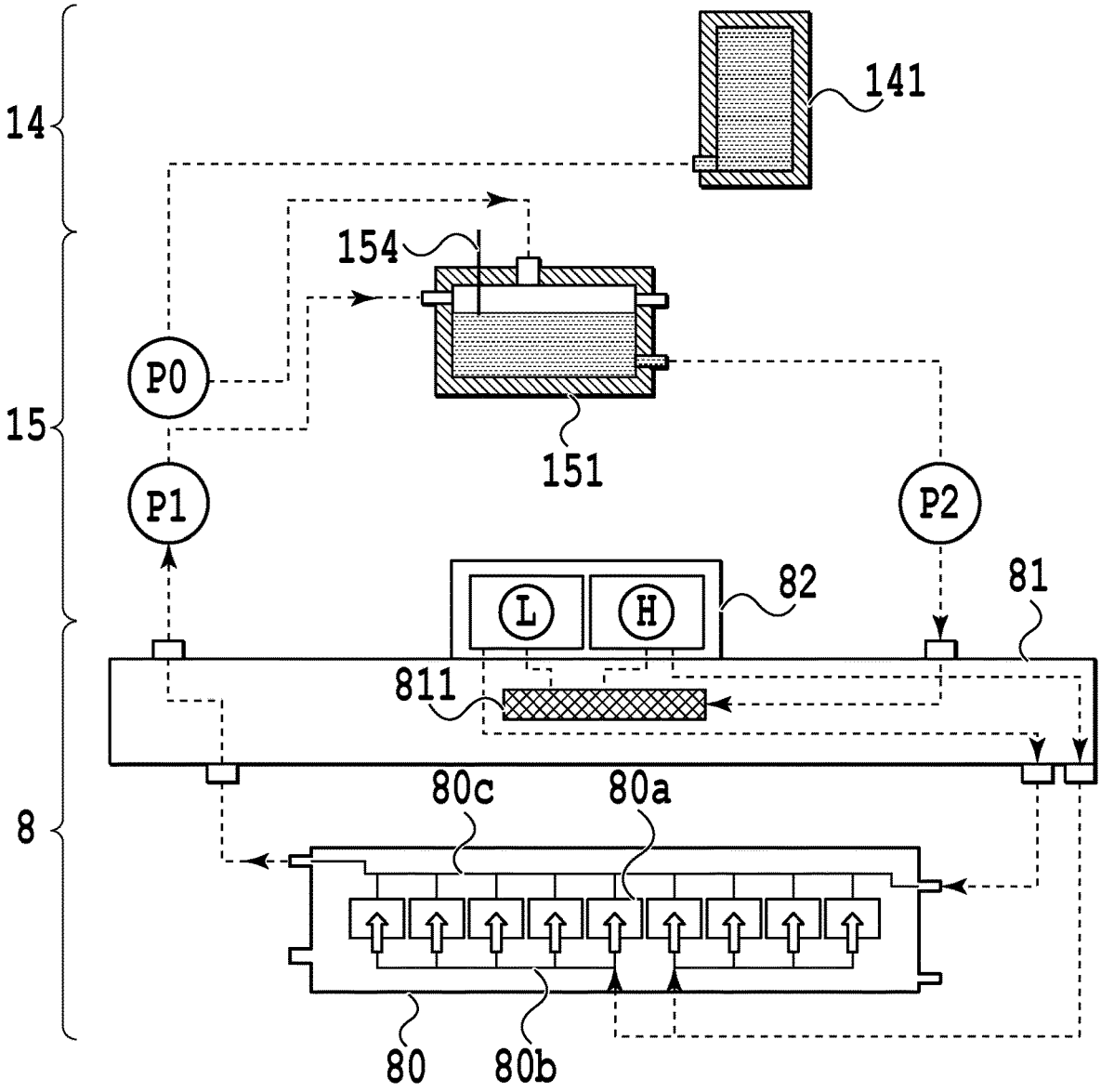
FIG. 9 is a view illustrating a circulation-type ink supply system.

FIG. 9 is a view illustrating a circulation type ink supply system that is employed in the recording apparatus 1. The circulation ink supply system is constituted by connecting the ink tank unit 14, the ink supply unit 15, and the recording head 8 to each other. Here, a circulation system relating to one color of ink is illustrated, but the circulation system is actually prepared for every ink color.

A main tank 141 that stores relatively large capacity of ink is provided in the ink tank unit 14. A buffer tank 151, and three pumps P0, P1, and P2 which are connected to the buffer tank 151 are included in the ink supply unit 15. The circulation pumps P1 and P2 allow ink in the entirety of a circulation route to flow in such a manner that ink in the supply system moves from the circulation pump P1 in a direction toward the circulation pump P2 through the buffer tank 151.

A liquid surface level sensor 154 is provided in the buffer tank 151. The liquid surface level sensor 154 includes two pins, and can grasp a position (height) of an ink liquid surface by detecting presence or absence of a conduction current between the two pins. That is, it is possible to detect a situation the ink liquid surface inside the buffer tank 151 reaches the height of the liquid surface level sensor 154 by using the liquid surface level sensor 154. A supplement pump P0 operates when an ink residual amount inside the buffer tank 151 decreases to supplement new ink from the main tank 141. In ink supplement, the pump P0 is controlled so that the height of the ink liquid surface does not exceed the height of the liquid surface level sensor 154. That is, in a case where the ink liquid surface inside the buffer tank 151 reaches the height of the liquid surface level sensor 154, the ink supply control unit 209 controls the pump P0, and stops the ink supplement from the main tank 141 to the buffer tank 151.

The recording head 8 includes an ink ejection unit 80, a circulation unit 81, and a negative pressure control unit 82. The ink ejection unit 80 has a structure configured to eject an ink droplet in accordance with ejection data. Here, the following type is employed. That is, a heater is disposed in an individual recording element, a voltage is applied to the heater so as to cause film boiling to occur in ink, and ink is ejected from an ejection port in accordance with bubble growth energy. The negative pressure control unit 82 performs adjustment so that ink flows in a normal direction at an appropriate pressure in the ink ejection unit 80. The circulation unit 81 executes a circulation operation by controlling supply of ink from the buffer tank 151 to the negative pressure control unit 82, and recovery of ink from the ink ejection unit 80 to the buffer tank 151.

Ink that is supplied from the buffer tank 151 to the circulation unit 81 is supplied to the negative pressure control unit 82 through a filter 811. In the negative pressure control unit 82, a negative pressure control unit H that allows ink to flow out at a relatively high pressure, and a negative pressure control unit L that allows ink to flow out at a relatively low pressure are disposed. Ink that flows out from the negative pressure control unit H, and ink that flows out from the negative pressure control unit L are supplied to the ink ejection unit 80 along individual routes through the circulation unit 81.

In the ink ejection unit 80, a plurality of recording element substrates 80*a*, in which a plurality of nozzles are arranged in the y direction, are further arranged in the y direction, and thus a long nozzle row is formed. In addition, a common supply flow passage 80*b* that guides ink supplied at a relatively high pressure by the negative pressure control unit H, and a common recovery flow passage 80*c* that guides ink supplied at a relatively low pressure by the negative pressure control unit L are also formed in the ink ejection unit 80. In addition, an individual flow passage that is connected to the common supply flow passage 80*b*, and an individual flow passage that is connected to the common recovery flow passage 80*c* are formed in each of the individual recording element substrate 80*a*. Due to occurrence of a pressure difference between the two negative pressure control units, an ink flow is formed in the individual recording element substrates 80*a* in such a manner that ink flows in from the common supply flow passage 80*b* having a relatively high pressure and ink flows out to the common recovery flow passage 80*c* having a relatively low pressure. In addition, when the ejection operation in the recording element substrate 80*a* is performed, a part of circulating ink is consumed due to ejection, but remaining ink flows back to the circulation unit 81 through the common recovery flow passage 80*c*, and returns to the buffer tank 151 through the circulation pump P1.

In the circulation type ink supply system, heat that is generated in the ejection operation of the recording element substrate 80*a* is deprived by the circulating ink. Accordingly, even when the ejection operation is continuously performed, it is possible to suppress ejection failure along with heat accumulation. In addition, due to a configuration in which bubbles or thickened ink which occurs in accordance with the ejection operation, foreign matters, and the like are less likely to stay, and thus it is possible to maintain a nozzle ejection state in a satisfactory manner.

Particularly, bubbles which occur along with the ejection operation have properties of moving to an upward side. Accordingly, when performing the recording operation in a state in which the ejection port surface 8*a*, that is, the ink ejection unit 80 is inclined as described above, there is a concern that the bubbles may residue in a specific recording element substrate 80*a* or a specific ejection port. However, when employing the circulation type ink supply system, it is also possible to reliably recover bubbles which occur through the common recovery flow passage 80*c*, and thus the degree of freedom in a posture of the recording head 8 in the ejection operation also increases. As a result, the recording position as in FIG. 3 is also possible, and thus it is possible to realize a reduction in size of the apparatus.

However, at a maintenance position, it is preferable that the ejection port surface 8*a* is set to be horizontal so as to allow an effect of the gravity to evenly operate on the individual recording element substrates 80*a* and the individual ejection ports. Accordingly, it is necessary for the recording head 8 to appropriately move between the standby position illustrated in FIG. 1, the recording position illustrated in FIG. 3, and the maintenance position illustrated in FIG. 7, and thus there is a demand for a configuration capable of realizing the movement at a short time and in a simple manner.

<With Regard to Ejection Component>

Figure 10A:
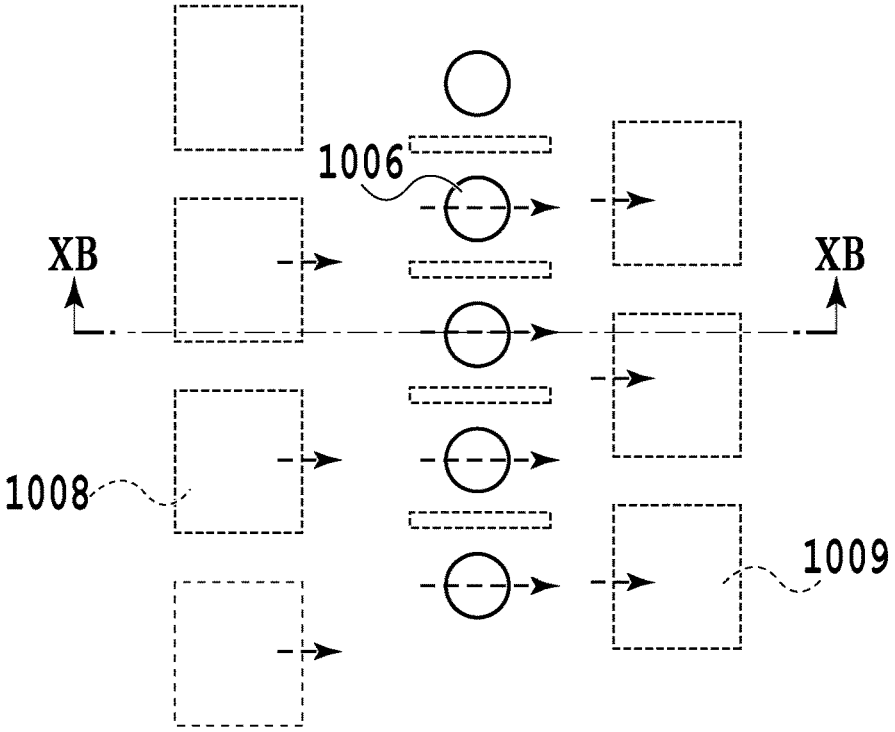
FIGS. 10A and 10B are views illustrating a configuration of an ejection component in an ink ejection unit.
Figure 10B:
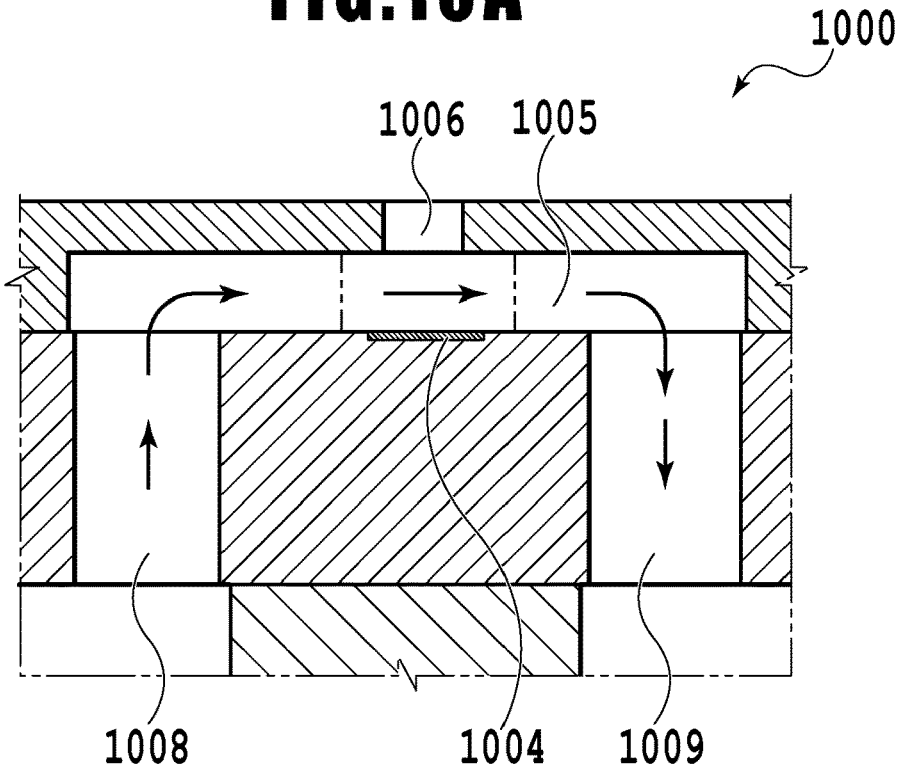
Figure 11:
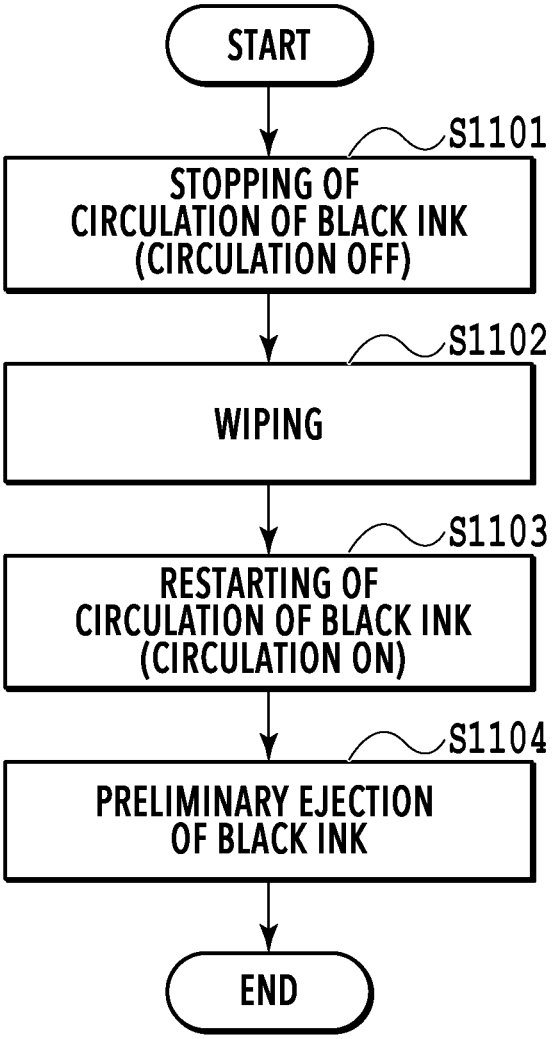
FIG. 11 is a flowchart of a wiping sequence according to a first embodiment.

FIG. 10A is a schematic plan view illustrating a part of the recording element substrates 80*a* in an enlarged manner, and FIG. 10B is a schematic cross-sectional view taken along cross-sectional line XB-XB in FIG. 10A. A pressure chamber 1005 that is filled with ink, and an ejection port 1006 through which the ink is ejected are provided in each of the recording element substrates 80*a*. In the pressure chamber 1005, a recording element 1004 is provided at a position that faces the ejection port 1006. In addition, a plurality of individual supply flow passages 1008 which are connected to the common supply flow passage 80*b*, and a plurality of individual recovery flow passages 1009 which are connected to the common recovery flow passage 80*c* are formed for every ejection port 1006, in the recording element substrates 80*a*.

According to the above-described configuration, in the recording element substrates 80*a*, there is generated a flow of ink that flows in from the common supply flow passage 80*b* in which a negative pressure is relatively weak (a pressure is high) and flows out to the common recovery flow passage 80*c* in which a negative pressure is relatively strong (a pressure is low). More specifically, ink flows in the order of the common supply flow passage 80*b*→each of the individual supply flow passages 1008→the pressure chamber 1005→each of the individual recovery flow passages 1009 the common recovery flow passage 80*c*. When ink is ejected by the recording element 1004, a part of the ink that moves from the common supply flow passage 80*b* to the common recovery flow passage 80*c* is ejected from the ejection port 1006, and is discharged to the outside of the recording head 8. On the other hand, ink that is not ejected from the ejection port 1006 is recovered to a recovery flow passage C4 through the common recovery flow passage 80*c*.

<With Regard to Preliminary Ejection>

The preliminary ejection is an operation of discharging ink that is pushed into ejection ports through the wiping process, and is subjected to color mixing, and is performed after performing the first wiping process or the second wiping process. The reason for this is as follows. Since ejection port rows are sequentially wiped in the wiping processes, in a series of wiping operations, ink that is wiped off from an ejection port row at a front stage may adhere to an ejection port row at a rear stage during wiping the ejection port row at the rear stage, and thus there is a concern that mixed-color ink may remain. Accordingly, in this embodiment, the preliminary ejection operation is performed with the cap member 10*a* after the wiping process. The mixed-color ink inside ejection ports is discharged through the preliminary ejection.

Hereinafter, preferred embodiments of the invention will be described on the basis of the basic configuration as described above.

First Embodiment

This embodiment is configured to countermeasure a situation in which when using black ink, the black ink is concentrated and thickened in the ejection port 1006 during a wiping sequence, and thus it becomes difficult to eject the black ink from the ejection port 1006. This phenomenon results from that the black ink in this embodiment is ink that includes a large amount of pigments and is likely to be thickened in comparison to color ink of cyan, magenta, and yellow.

<With Regard to Wiping Sequence>

Hereinafter, a wiping sequence according to this embodiment will be described with reference to FIGS. 11, and FIG. 12A to 12D.

Figure 12A:
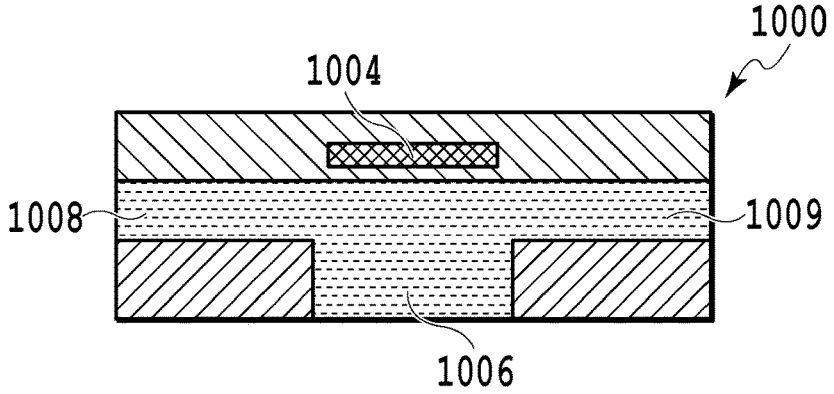
FIGS. 12A to 12D are views illustrating the wiping sequence according to the first embodiment.

In step S1101, the print controller 202 controls the ink supply control unit 209 to stop ink circulation in a circulation system of black ink (circulation OFF). FIG. 12A illustrates a state in which circulation is stopped in an ejection component 1000 of the circulation system of black ink. As illustrated in the same drawing, the ejection component 1000 is filled with the black ink, but an ink flow inside the ejection port 1006 due to circulation does not occur.

Figure 12B:
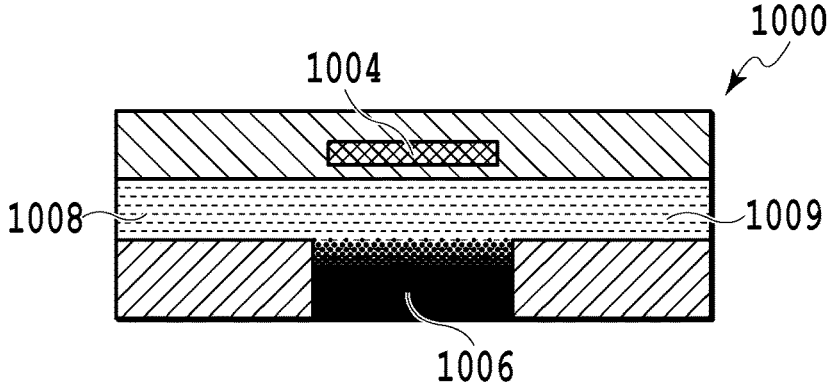
Figure 12C:
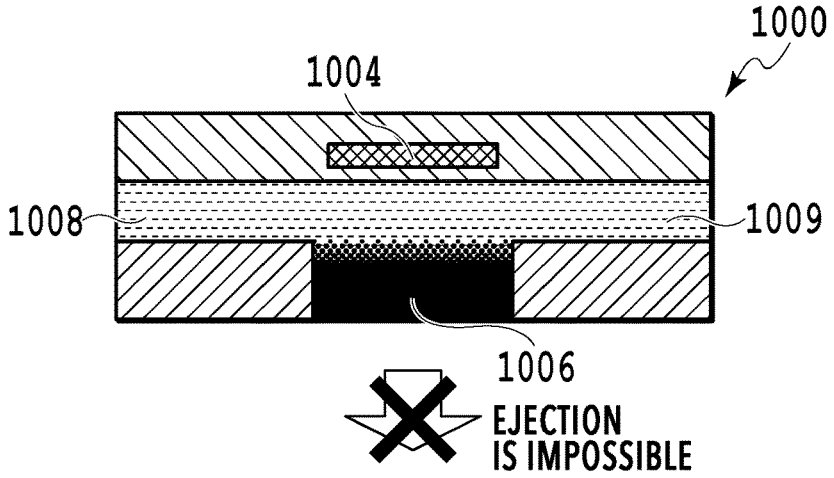

In step S1102, the print controller 202 controls the maintenance control unit 210 to drive the blade wiper 171*a* so as to wipe the ejection port surface 8*a* (that is, the first wiping process is performed). Meanwhile, the ejection port surface 8*a* is not capped with the cap unit 10, and the black ink in the ejection port 1006 comes into contact with the external air on the ejection port surface 8*a*, and thus moisture in the ink evaporates and concentration proceeds. FIG. 12B illustrates this state. In a case where the concentration of the black ink excessively proceeds, as illustrated in FIG. 12C, it is difficult to eject the black ink from the ejection port 1006 due to thickening. Furthermore, here, a case where the first wiping process is performed in step S1102 is illustrated, but another cleaning process may be performed instead of the first wiping process.

Figure 12D:
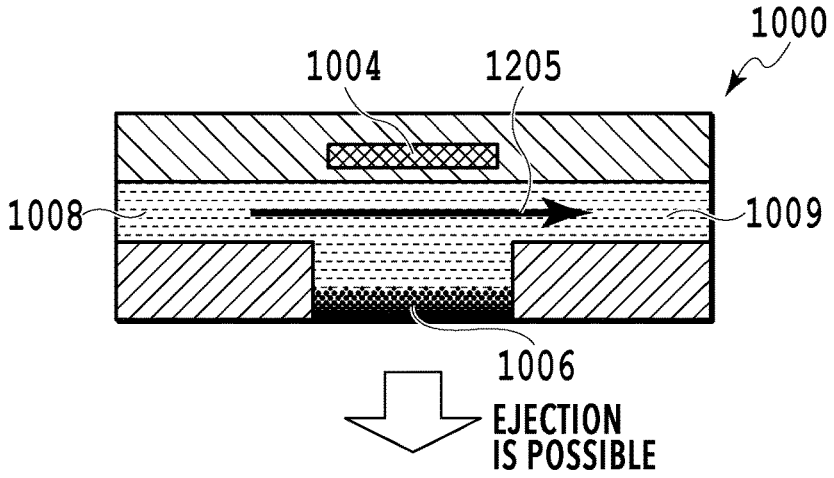

In step S1103, the print controller 202 controls the ink supply control unit 209 to restart the ink circulation in the circulation system of the black ink (circulation ON). When the circulation is restarted, as illustrated in FIG. 12D, concentrated ink in the ejection port 1006 flows out to the individual recovery flow passage 1009 by an ink flow 1205. As a result, in the ejection port 1006, the volume of the concentrated ink is reduced, and the ejection port 1006 is filled with ink that is not concentrated instead of the concentrated ink. Furthermore, the concentrated ink in the vicinity of the ejection port surface 8*a* may remain as illustrated in FIG. 12D.

Ink circulation is restarted in step S1103, and after passage of a predetermined time (for example, five seconds), in step S1104, the print controller 202 drives the recording element 1004 to perform preliminary ejection of black ink. Furthermore, the concentrated ink that residues inside the ejection port 1006 is reduced through the circulation restarting in step S1103, and thus it is possible to eject the black ink from the ejection port 1006 without a problem due to this step. The above-described configuration corresponds to the contents of the wiping sequence in this embodiment.

Furthermore, in the above-described example, description is given of a case where both of the ink circulation and the preliminary ejection are executed after wiping, but this embodiment is not limited thereto. Consideration can also be made on an embodiment in which any one of the ink circulation and the preliminary ejection is executed after wiping.

<With Regard to Effect of This Embodiment>

According to this embodiment, it is possible to prevent a situation in which the ejection port 1006 is clogged by concentrated ink after wiping and enters an ejection failure state.

Second Embodiment

In the first embodiment, description has been given of a case where black ink is used. In this embodiment, description will be given of a case where color ink of cyan, magenta, yellow, and the like are used in addition to the black ink, and ON/OFF of circulation of all colors of ink is collectively controlled (that is, ON/OFF of circulation is not controlled for each color). Furthermore, hereinafter, a difference from the above-described embodiment will be mainly described, and description of the same contents as in the above-described embodiment will be appropriately omitted.

<With Regard to Wiping Sequence>

Figure 13:
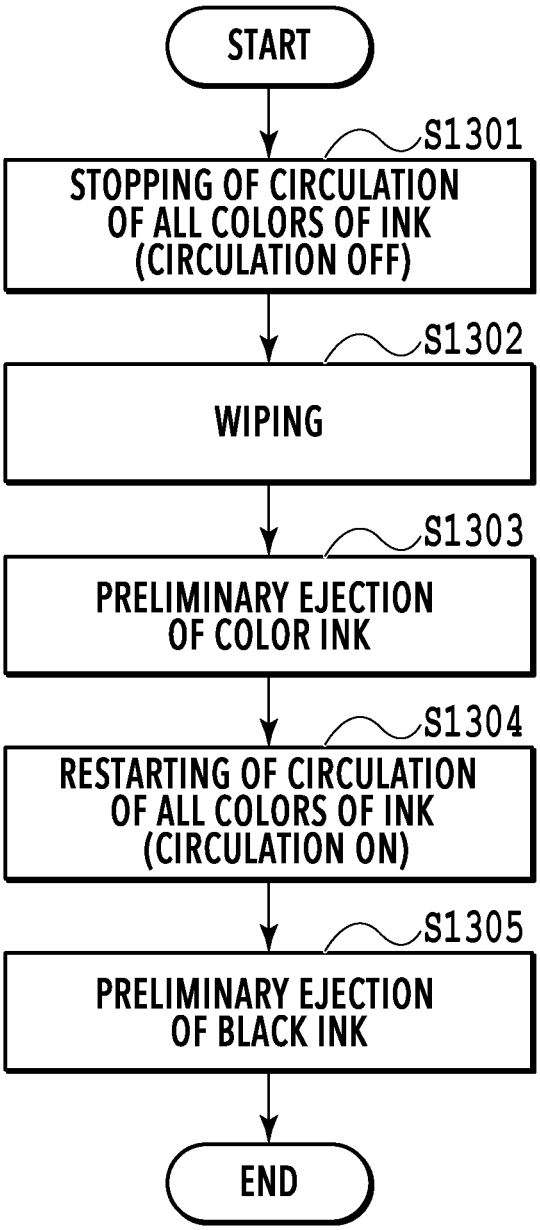
FIG. 13 is a flowchart of a wiping sequence according to a second embodiment.

Hereinafter, a wiping sequence according to this embodiment will be described with reference to FIG. 13 and FIG. 14.

In step S1301, the print controller 202 controls the ink supply control unit 209 to stop ink circulation in circulation systems of all colors of ink (that is, circulation systems of C ink, M ink, Y ink, and K ink) (circulation OFF). In subsequent step S1302, a wiping process is performed. When performing the wiping while continuing the circulation, mixed-color ink adhered to the ejection port surface 8*a* due to the wiping may diffuse to an ink flow passage. Accordingly, ink circulation is stopped before performing the wiping process. (a) of FIG. 14 illustrates a state in which circulation of color ink is stopped in the ejection component 1000 of a circulation system of the color ink, and (d) of FIG. 14 illustrates a state in which circulation of black ink is stopped in the ejection component 1000 of the circulation system of the black ink. As illustrated in the drawings, each ejection component 1000 is filled with ink, but an ink flow does not occur.

In step S1302, the print controller 202 controls the maintenance control unit 210 to operate the blade wiper 171*a* so as to wipe the ejection port surface 8*a* (that is, the first wiping process is performed). Meanwhile, the ejection port surface 8*a* is not capped with the cap unit 10. Accordingly, as in the first embodiment, the black ink inside the ejection port 1006 of the circulation system of the black ink is concentrated as illustrated in (e) of FIG. 14. In a case where the concentration excessively proceeds, as illustrated in (f) of FIG. 14, it is difficult to eject the black ink from the ejection port 1006 due to thickening.

Figure 14:
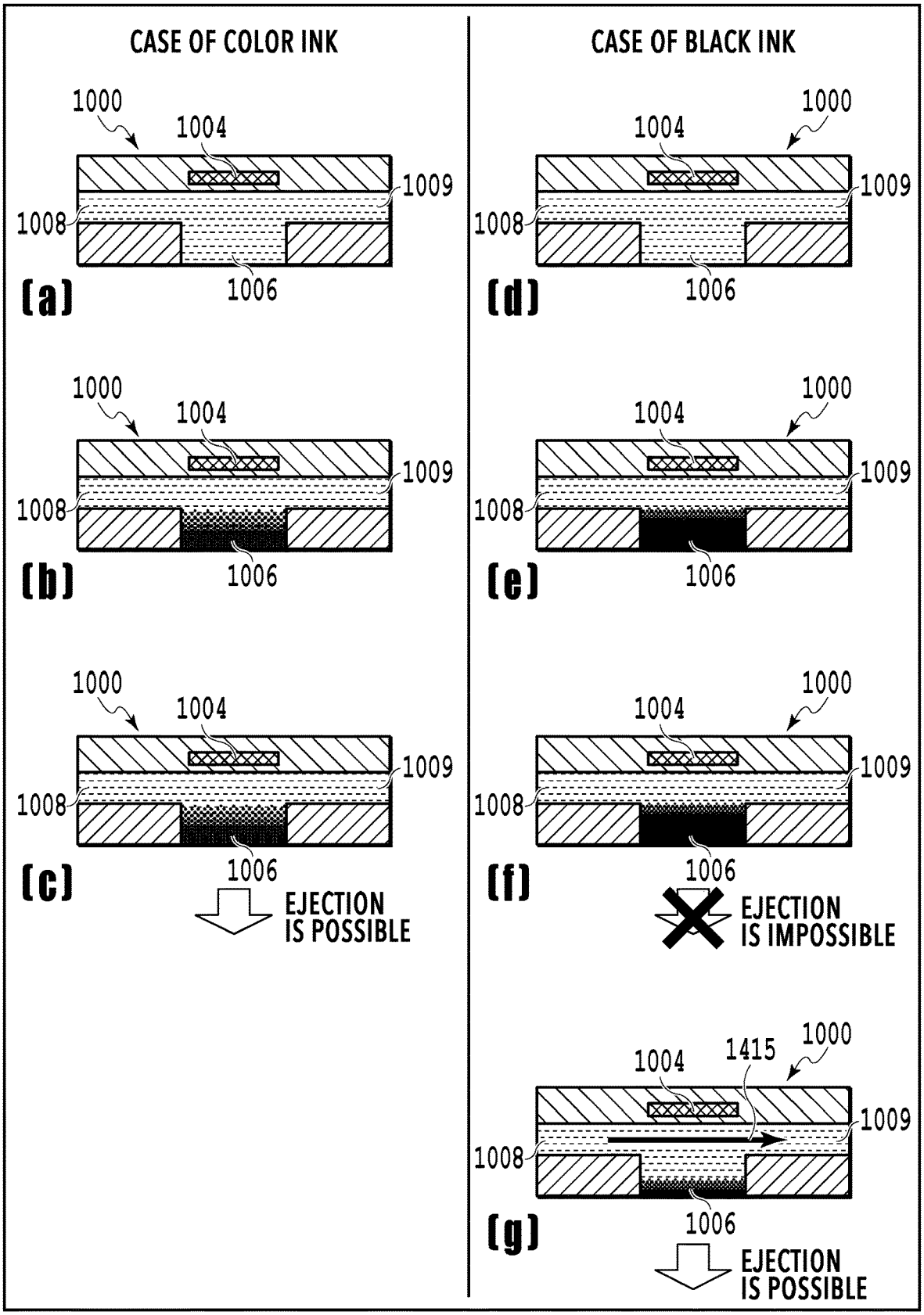
FIG. 14 is a view illustrating the wiping sequence according to the second embodiment.

In contrast, in the ejection port 1006 of the circulation system of the color ink, the color ink is concentrated as illustrated in (b) of FIG. 14. This is the same as in the black ink, but the color ink has lower viscosity in comparison to the black ink. Accordingly, even in a case where the color ink comes into contact with the external air for approximately the same time, a state capable of ejecting the color ink from the ejection port 1006 is maintained as illustrated in (c) of FIG. 14.

In addition, in this embodiment, since the black ink and the color ink are used, there is a concern that mixed-color ink may be mixed into the circulation systems of respective colors due to the wiping.

Furthermore, here, a case where the first wiping process is performed in step S1302 is illustrated, but other cleaning processes such as the second wiping process and the cap suction process may be performed instead of the first wiping process.

In step S1303, the print controller 202 drives the recording element 1004 in the circulation system of the color ink so as to perform preliminary ejection of the color ink. As a result, concentrated color ink and mixed-color ink are discharged to the outside of the circulation system of the color ink. Furthermore, as described above, the color ink has lower viscosity in comparison to the black ink. Accordingly, even in a case where concentration proceeds, a state capable of ejecting the color ink from the ejection port is maintained. Accordingly, it is not necessary to generate an ink flow by restarting circulation of the color ink when performing the preliminary ejection of the color ink.

In step S1304, the print controller 202 controls the ink supply control unit 209 to restart ink circulation in the circulation systems of all colors of ink (that is, circulation systems of C ink, M ink, Y ink, and K ink) (circulation ON). In the circulation system of the black ink after restarting the circulation, as illustrated in (g) of FIG. 14, concentrated ink inside the ejection port 1006 flows out to the individual recovery flow passage 1009 due to an ink flow 1415. As a result, in the ejection port 1006, the volume of the concentrated ink is reduced, and the ejection port 1006 is filled with the black ink that is not concentrated.

In step S1305, the print controller 202 drives the recording element 1004 in the circulation system of the black ink to perform preliminary ejection of the black ink. As a result, concentrated black ink and mixed-color ink are discharged to the outside of the circulation system of the black ink. Furthermore, in step S1304, concentrated ink that residues inside the ejection port 1006 is reduced, and thus it is possible to eject the black ink from the ejection port 1006 without a problem due to this step. The above-described configuration corresponds to the contents of the wiping sequence in this embodiment.

<With Regard to Modification Example of This Embodiment>

In this embodiment, as described above, the concentrated ink or the mixed-color ink that residues inside the ejection port 1006 is discharged to the outside of the circulation system through the preliminary ejection. However, a part of the concentrated ink or the mixed-color ink flows out from the individual recovery flow passage 1009 due to the ink flow, and remains inside the circulation system. The concentrated ink or the mixed-color ink becomes a cause for occurrence of printing failure, and it is preferable to discharge the concentrated ink or the mixed-color ink as much as possible. Accordingly, for example, consideration can be made on an embodiment in which the discharge amount is controlled for every recording element substrate 80*a*, that is, the number of times of ejection from the ejection component 1000 of the recording element substrate 80*a* on a downstream side is greater than the number of times of ejection from the ejection component 1000 of the recording element substrate 80*a* on an upstream side. According to this, it is possible to eject a large amount of concentrated ink or mixed-color ink to the outside of the circulation system.

<With Regard to Effect of This Embodiment>

According to this embodiment, it is possible to reduce the concentrated ink that residues inside the ejection port 1006 after wiping, and thus it is possible to prevent a situation in which the ejection port 1006 is clogged and enters an ejection failure state. In addition, it is possible to discharge the mixed-color ink that may occur in the circulation systems of respective colors due to the wiping to the outside of the circulation systems, and thus it is possible to suppress a printing failure due to the mixed-color ink.

Third Embodiment

In the second embodiment, description has been given of a case where the black ink and the color ink are used, and ON/OFF of circulation of all colors of ink is collectively controlled. In this embodiment, description will be given of an example of a case where the black ink and the color ink are used, and ON/OFF of ink circulation can be controlled for each color.

<With Regard to Wiping Sequence>

Figure 15:
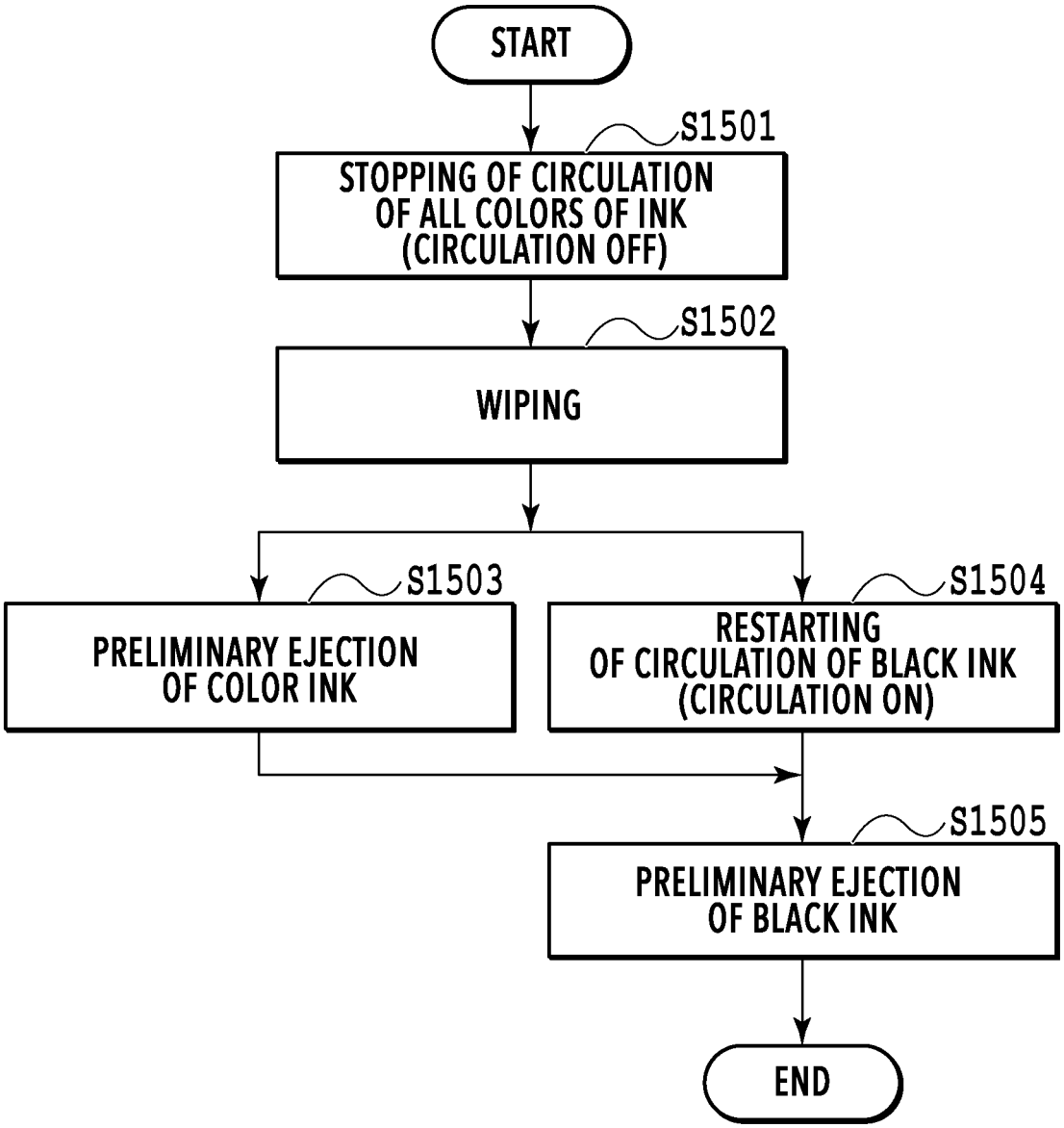
FIG. 15 is a flowchart of a wiping sequence according to a third embodiment.

Hereinafter, a wiping sequence according to this embodiment will be described with reference to FIG. 15.

In step S1501, the print controller 202 controls the ink supply control unit 209 to stop ink circulation in the circulation systems of all colors of ink (that is, circulation systems of C ink, M ink, Y ink, and K ink) (circulation OFF).

In step S1502, the print controller 202 controls the maintenance control unit 210 to drive the blade wiper 171*a* so as to wipe the ejection port surface 8*a* (that is, the first wiping process is performed). Meanwhile, the ejection port surface 8*a* is not capped with the cap unit 10. Accordingly, as in the second embodiment, concentration of the black ink inside the ejection port 1006 of the circulation system of the black ink proceeds, and in a case where the concentration excessively proceeds, it is difficult to eject the black ink from the ejection port. On the other hand, even in the ejection port 1006 of the circulation system of the color ink, concentration of the color ink proceeds. However, the color ink has lower viscosity in comparison to the black ink. Accordingly, even in a case where the concentration excessively proceeds, a state capable of ejecting the color ink from the ejection port is maintained. In addition, there is a concern that mixed-color ink may be mixed into the circulation systems of respective colors due to the wiping. Furthermore, here, a case where the first wiping process is performed in step S1502 is illustrated, but other cleaning processes such as the second wiping process and the cap suction process may be performed instead of the first wiping process.

In step S1503, the print controller 202 drives the recording element 1004 in the circulation system of the color ink so as to perform preliminary ejection of the color ink. As a result, concentrated color ink and mixed-color ink are discharged to the outside of the circulation system of the color ink. Furthermore, as described above, the color ink has lower viscosity in comparison to the black ink. Accordingly, even in a case where concentration proceeds, a state capable of ejecting the color ink from the ejection port is maintained. Accordingly, it is not necessary to generate an ink flow by restarting circulation of the color ink when performing the preliminary ejection of the color ink.

In parallel to the process in step S1503, in step S1504, the print controller 202 controls the ink supply control unit 209 to restart ink circulation in the circulation system of the black ink (circulation ON). In the circulation system of the black ink after restarting the circulation, concentrated ink inside the ejection port 1006 flows out to the individual recovery flow passage 1009. As a result, in the ejection port 1006, the volume of the concentrated ink is reduced, and the ejection port 1006 is filled with the black ink that is not concentrated.

In step S1505, the print controller 202 drives the recording element 1004 in the circulation system of the black ink to perform preliminary ejection of the black ink. As a result, concentrated black ink and mixed-color ink are discharged to the outside of the circulation system of the black ink. In step S1504, concentrated ink that residues inside the ejection port 1006 is reduced, and thus it is possible to eject the black ink from the ejection port 1006 without a problem due to this step. The above-described configuration corresponds to the contents of the wiping sequence in this embodiment. Further, in a case where the black ink evaporate easily, the print controller 202 may stop the circulation of the black ink after stopping the preliminary ejection of the black ink. Thus, it becomes possible to evaporation of the black ink.

<With Regard to Effect of This Embodiment>

In this embodiment, the preliminary ejection of the color ink (step S1503) and the circulation of the black ink (step S1504) are simultaneously executed. According to this, it is possible to further shorten time necessary for the wiping sequence in comparison to the second embodiment.

Fourth Embodiment

In this embodiment, description will be given of an example of a case where the black ink and the color ink are used, and ON/OFF of ink circulation can be controlled for each color.

<With Regard to Wiping Sequence>

Figure 16:
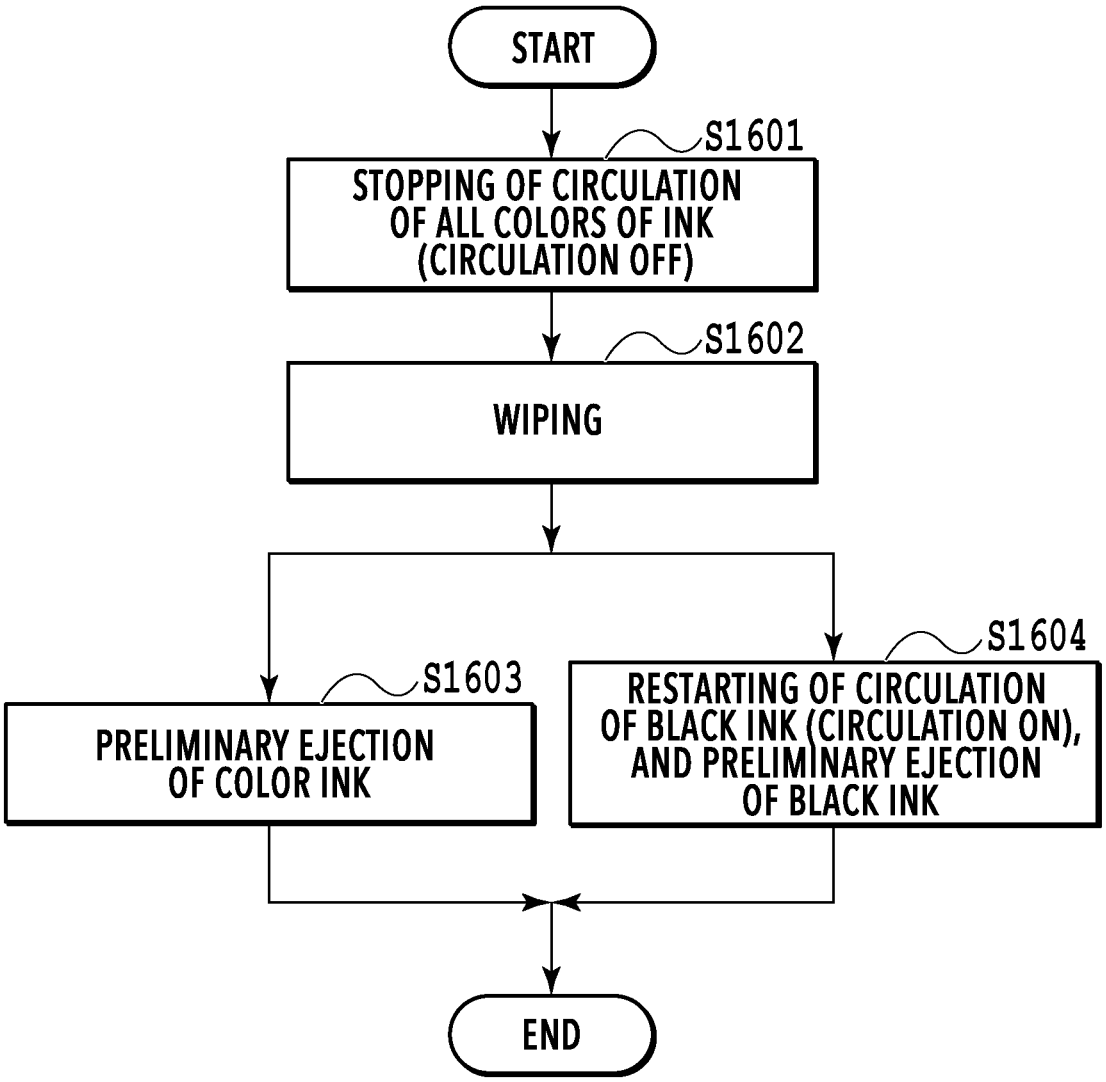
FIG. 16 is a flowchart of a wiping sequence according to a fourth embodiment.

Hereinafter, a wiping sequence according to this embodiment will be described with reference to FIG. 16.

In step S1601, the print controller 202 controls the ink supply control unit 209 to stop ink circulation in the circulation systems of all colors of ink (that is, circulation systems of C ink, M ink, Y ink, and K ink) (circulation OFF).

In step S1602, the print controller 202 controls the maintenance control unit 210 to drive the blade wiper 171*a* so as to wipe the ejection port surface 8*a* (that is, the first wiping process is performed). As a result, as in the second and third embodiments, concentration of the black ink inside the ejection port in the circulation system of the black ink, and concentration of the color ink inside the ejection port in the circulation system of the color ink proceed. In addition, there is a concern that mixed-color ink may be mixed into the circulation systems of respective colors due to the wiping. Furthermore, here, a case where the first wiping process is performed in step S1602 is illustrated, but other cleaning processes such as the second wiping process and the cap suction process may be performed instead of the first wiping process.

In step S1603, the print controller 202 drives the recording element 1004 in the circulation system of the color ink so as to perform preliminary ejection of the color ink. As a result, concentrated color ink and mixed-color ink are discharged to the outside of the circulation system of the color ink.

In parallel to the process in step S1603, in step S1604, the print controller 202 controls the ink supply control unit 209 to restart ink circulation in the circulation system of the black ink. In addition, in parallel to this, the print controller 202 drives the recording element 1004 in the circulation system to perform preliminary ejection of the black ink. As described above, in this step, circulation of the black ink and the preliminary ejection of the black ink are simultaneously started. At this time, the print controller 202 controls the discharge amount through the preliminary ejection. Specifically, the print controller 202 adjusts the number of times of ejection per one nozzle and per unit time so that the discharge amount from the circulation system through the preliminary ejection becomes greater than a flow rate (also referred to as "circulation flow rate") that is circulated by driving the circulation pumps P1 and P2. The above-described configuration corresponds to the contents of the wiping sequence in this embodiment.

<With Regard to Modification Example of This Embodiment>

In this embodiment, description has been given of a case where a cleaning process such as the first wiping process is performed in step S1602, but the discharge amount through the preliminary ejection may be appropriately changed in correspondence with the contents of the cleaning process that is performed in step S1602. That is, the degree of occurrence of mixed-color ink in the circulation system is different in correspondence with the contents of the cleaning process, and thus the discharge amount is adjusted in correspondence with the contents. Specifically, when performing a cleaning process in which a large amount of mixed-color ink occurs in the circulation system, the discharge amount is set to be greater in comparison to a case where a cleaning process is performed in which the mixed-color ink does not occur up to the above-described extent. For example, the following embodiment may be considered. That is, in a case where the cap suction process is performed, the discharge amount is set to the greatest. In addition, in a case where the second wiping process is performed, the discharge amount is reduced. In addition, in a case where the first wiping process is performed, the discharge amount is further reduced.

<With Regard to Effect of This Embodiment>

In this embodiment, the preliminary ejection of the color ink (step S1603) and the circulation of the black ink (step S1604) are simultaneously executed. According to this, it is possible to further shorten time necessary for the wiping sequence in comparison to the second embodiment.

In addition, in this embodiment, in the circulation system of the black ink, the discharge amount through the preliminary ejection is controlled to be greater than the circulation flow rate. According to this, it is possible to reduce the amount of the concentrated ink or the mixed-color ink that is recovered from the recording head 8, and thus it is possible to suppress a printing failure that is caused by the concentrated ink or the mixed-color ink.

Fifth Embodiment

In this embodiment, description will be given of an example of a case where the black ink and the color ink are used, and ON/OFF of ink circulation can be controlled for each color.

<With Regard to Wiping Sequence>

Figure 17:
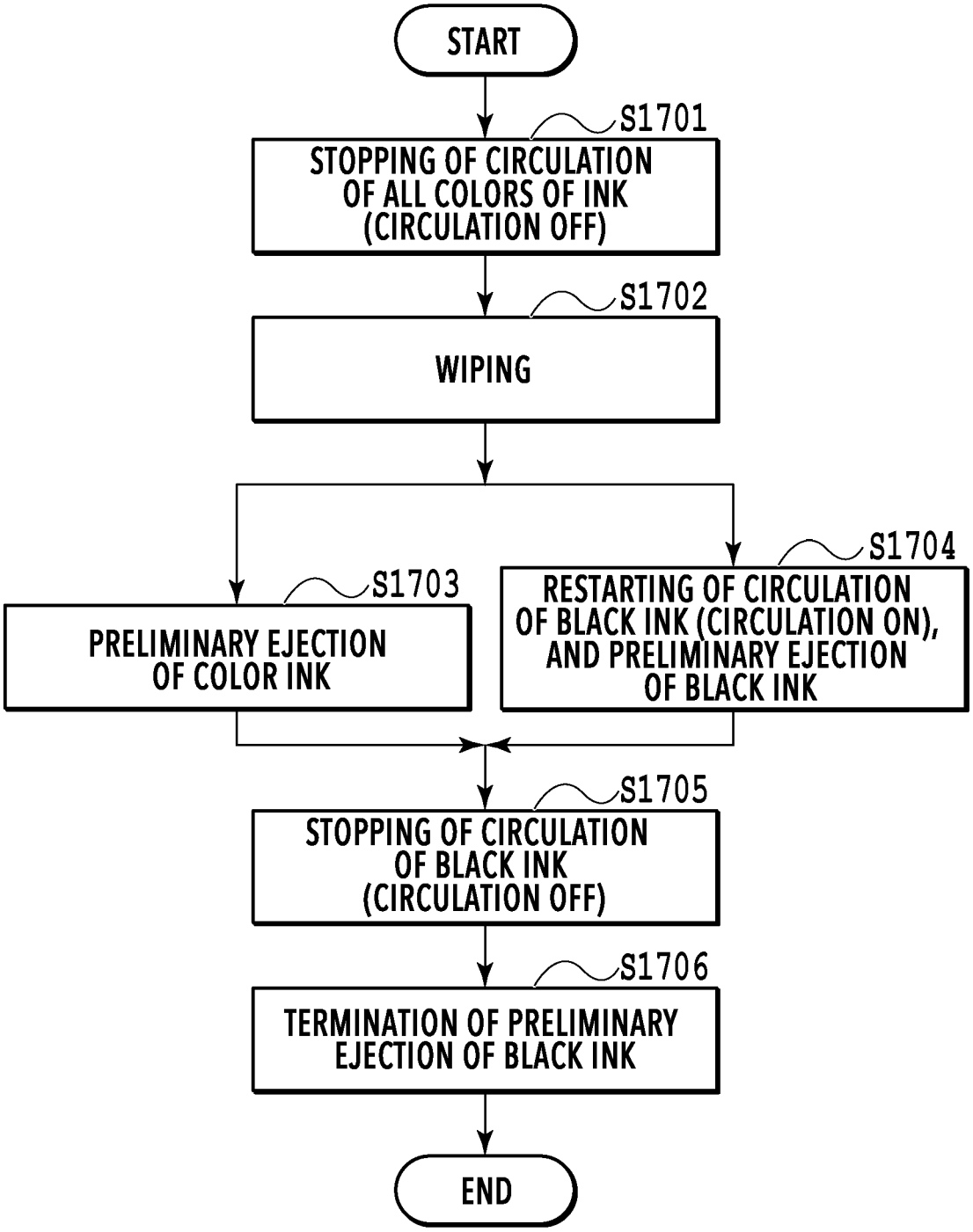
FIG. 17 is a flowchart of a wiping sequence according to a fifth embodiment.

Hereinafter, a wiping sequence according to this embodiment will be described with reference to FIG. 17.

In step S1701, the print controller 202 controls the ink supply control unit 209 to stop ink circulation in the circulation systems of all colors of ink (that is, circulation systems of C ink, M ink, Y ink, and K ink) (circulation OFF).

In step S1702, the print controller 202 controls the maintenance control unit 210 to drive the blade wiper 171*a* so as to wipe the ejection port surface 8*a* (that is, the first wiping process is performed). As a result, as in the second to fourth embodiments, concentration of the black ink inside the ejection port in the circulation system of the black ink, and concentration of the color ink inside the ejection port in the circulation system of the color ink proceed. In addition, there is a concern that mixed-color ink may be mixed into the circulation systems of respective colors due to the wiping. Furthermore, here, a case where the first wiping process is performed in step S1702 is illustrated, but other cleaning processes such as the second wiping process and the cap suction process may be performed instead of the first wiping process.

In step S1703, the print controller 202 drives the recording element 1004 in the circulation system of the color ink so as to perform preliminary ejection of the color ink. As a result, concentrated color ink and mixed-color ink are discharged to the outside of the circulation system of the color ink.

In parallel to the process in step S1703, in step S1704, the print controller 202 controls the ink supply control unit 209 to restart ink circulation in the circulation system of the black ink. In addition, in combination with this, the print controller 202 drives the recording element 1004 in the circulation system to perform preliminary ejection of the black ink. As described above, with respect to the black ink, circulation and preliminary ejection are simultaneously executed. According to this, the concentrated ink or the mixed-color ink is discharged to the outside of the circulation system of the black ink while restoring ejection stability from the ejection port (characteristics capable of stably performing ejection from the ejection port) by reducing the thickened ink inside the ejection port.

In step S1705, the print controller 202 controls the ink supply control unit 209 to stop ink circulation in the circulation system of the black ink (circulation OFF).

In step S1706, the print controller 202 terminates preliminary ejection of the black ink by stopping the recording element 1004 in the circulation system of the black ink. The above-described configuration corresponds to the contents of the wiping sequence in this embodiment.

<With Regard to Modification Example of This Embodiment>

This embodiment may be applied to the case of the fourth embodiment. That is, the print controller 202 may control the discharge amount from the circulation system through the preliminary ejection to be greater than the circulation flow rate.

<With Regard to Effect of This Embodiment>

In this embodiment, with respect to the black ink, circulation and preliminary ejection are simultaneously performed, and then the circulation is stopped while continuously executing the preliminary ejection. According to this, it is possible to reduce the amount of the concentrated ink or the mixed-color ink that is recovered from the recording head 8, and thus it is possible to suppress a printing failure that is caused by the concentrated ink or the mixed-color ink.

Sixth Embodiment

In this embodiment, black ink is circulated in correspondence with installation environment of the recording apparatus 1. Furthermore, as in the third to fifth embodiments, in this embodiment, assumption is also made on a case where the black ink and the color ink are used and ON/OFF of ink circulation can be controlled for each color.

<With Regard to Wiping Sequence>

Figure 18:
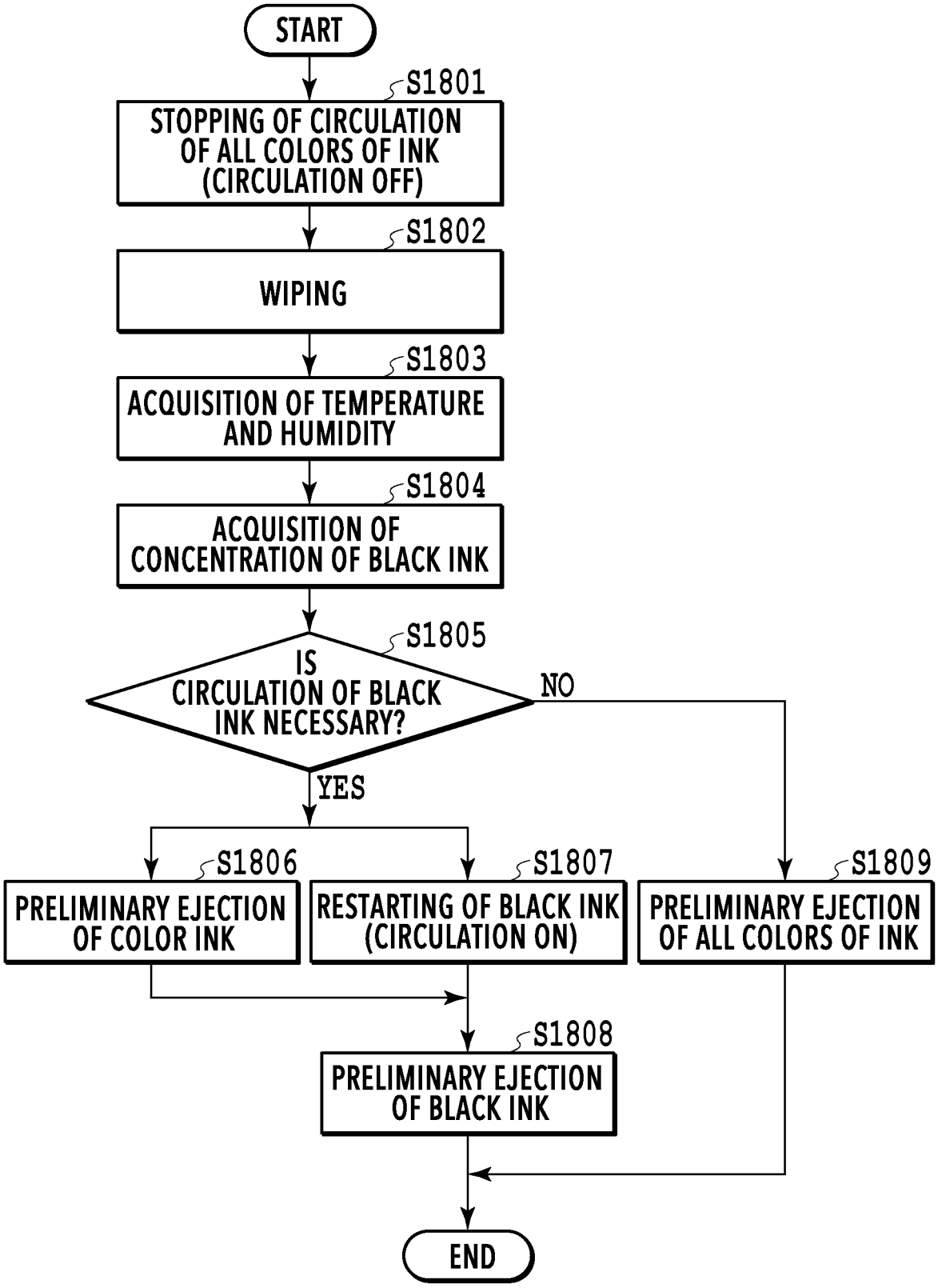
FIG. 18 is a flowchart of a wiping sequence according to a sixth embodiment.

Hereinafter, a wiping sequence according to this embodiment will be described with reference to FIG. 18.

In step S1801, the print controller 202 controls the ink supply control unit 209 to stop ink circulation in the circulation systems of all colors of ink (that is, circulation systems of C ink, M ink, Y ink, and K ink) (circulation OFF).

In step S1802, the print controller 202 controls the maintenance control unit 210 to drive the blade wiper 171*a* so as to wipe the ejection port surface 8*a* (that is, the first wiping process is performed). As a result, as in the second to fifth embodiments, concentration of the black ink inside the ejection port in the circulation system of the black ink, and concentration of the color ink inside the ejection port in the circulation system of the color ink proceed. In addition, there is a concern that mixed-color ink may be mixed into the circulation systems of respective colors due to the wiping. Furthermore, here, a case where the first wiping process is performed in step S1802 is illustrated, but other cleaning processes such as the second wiping process and the cap suction process may be performed instead of the first wiping process.

In step S1803, the print controller 202 acquires a temperature and a humidity of the installation environment of the recording apparatus 1. Furthermore, the recording apparatus 1 is provided with a thermometer and a hygrometer, and the print controller 202 can acquire the temperature and the humidity of the installation environment of the recording apparatus 1 at an arbitrary timing.

In step S1804, the print controller 202 acquires concentration information (referred to as "concentration N") of the black ink in the circulation system of the black ink. Furthermore, as the concentration N, a value calculated by the following Expression is stored in the ROM 203.

$$N_{X+1} = (N_X \times (J_n - I_n)) \div (J_n - I_n - V)$$

Here, $N_{X+1}$ represents a concentration after the recording operation, and $N_X$ represents a concentration before the recording operation. In addition, $J_n$ represents the amount of ink in the circulation system of the black ink before the recording operation, $I_n$ represents the amount of ink that is consumed through recording, and V represents the amount of evaporation from the circulation system. The print controller 202 calculates $N_{X+1}$ for every recording operation, and overwrites and saves the calculated value in the ROM 203 as the concentration N.

In step S1805, the print controller 202 determines whether or not ink circulation in the circulation system of the black ink is necessary on the basis of the temperature and the humidity which are acquired in step S1803, and the concentration N that is acquired in step S1804. Furthermore, details of the determination as to whether or not to execute the circulation of the black ink will be described later. When a determination result in step S1805 is YES, the process proceeds to step S1806 and step S1807. When the determination result in step S1805 is NO, the process proceeds to step S1809.

First, description will be given of a case where it is determined that ink circulation is necessary (YES in step S1805). In this case, in step S1806, the print controller 202 drives the recording element 1004 in the circulation system of the color ink to perform the preliminary projection of the color ink. As a result, concentrated color ink and mixed-color ink are discharged to the outside of the circulation system of the color ink. In addition, in parallel to the process in step S1806, in step S1807, the print controller 202 controls the ink supply control unit 209 to restart ink circulation in the circulation system of the black ink (circulation ON). Subsequently, in step S1808, the print controller 202 drives the recording element 1004 of the circulation system of the black ink to perform the preliminary ejection of the black ink. As a result, concentrated black ink and mixed-color ink are discharged to the outside of the circulation system of the black ink.

Next, description will be given of a case where it is determined that ink circulation is not necessary (NO in step S1805). In this case, in step S1809, the print controller 202 drives the recording element 1004 in the circulation systems of all colors of ink to perform preliminary ejection of the ink. As a result, concentrated black ink and mixed-color ink are discharged to the outside of the circulation system of the black ink, and concentrated color ink and mixed-color ink are discharged to the outside of the circulation systems of the color ink. The above-described configuration corresponds to the contents of the wiping sequence in this embodiment.

<With Regard to Determination as to Whether or Not to Execute Circulation Black Ink>

Hereinafter, description will be given of the determination as to whether or not to execute circulation of the black ink in step S1805.

Figures 19A, 19B:
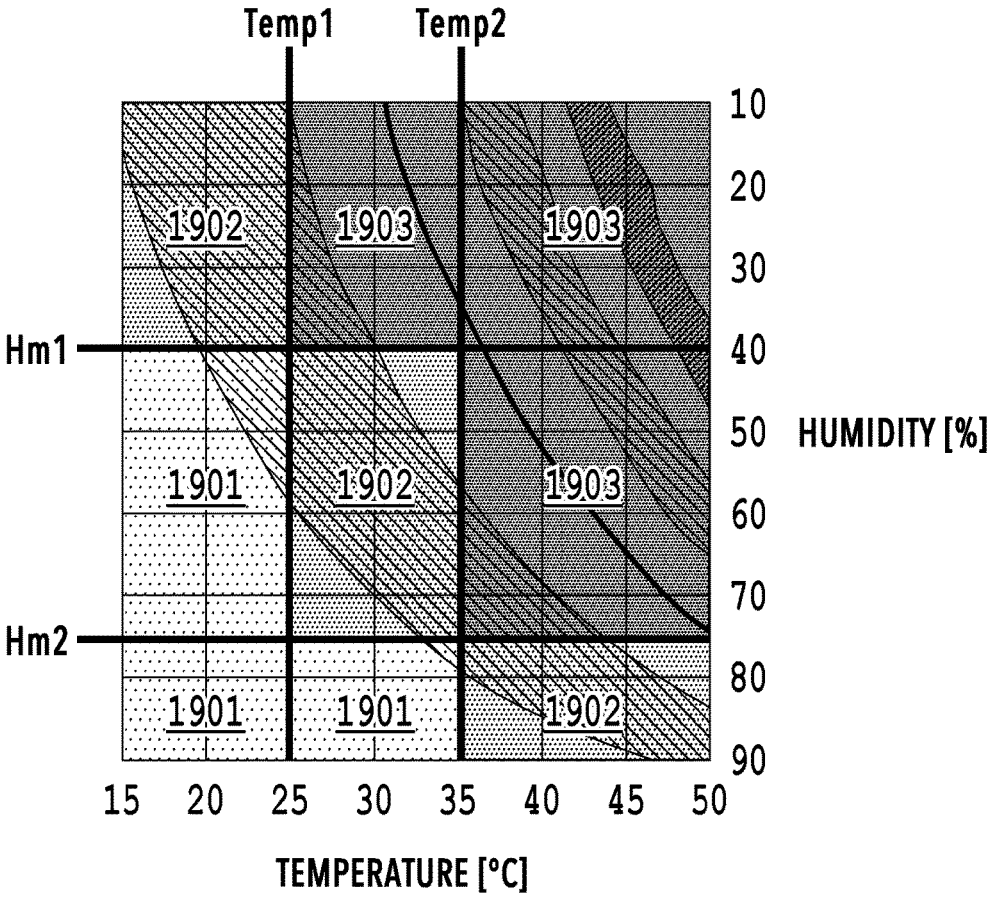
FIGS. 19A and 19B are views illustrating a wiping sequence according to the sixth embodiment.

In the determination as to whether or not to execute circulation of the black ink, first, a temperature and humidity state of the installation environment is classified by using a graph exemplified in FIG. 19A on the basis of the temperature and the humidity which are acquired in step S1803. For example, in the case of using the graph illustrated in FIG. 19A, classification is made into one of a first temperature and humidity state 1901, a second temperature and humidity state 1902, and a third temperature and humidity state 1903. The first temperature and humidity state 1901 is a low-temperature and high-humidity state, that is, a state in which ink is less likely to concentrate. The third temperature and humidity state 1903 is a high-temperature and low-humidity state, that is, a state in which ink is likely to concentrate. The second temperature and humidity state 1902 is an intermediate state between the first temperature and humidity state 1901 and the third temperature and humidity state 1903.

Subsequently, determination is made as to whether or not circulation of the black ink is necessary by using a table exemplified in FIG. 19B on the basis of the concentration N that is acquired in step S1804, and the temperature and humidity state that is classified as described above. In the case of using the table illustrated in FIG. 19B, when the concentration N is 0.089 or greater, it is determined that circulation of the black ink is necessary regardless of the temperature and humidity state. On the other hand, when the concentration N is less than 0.089, it may be determined that circulation of the black ink is not necessary in correspondence with the temperature and humidity state in some cases.

<With Regard to Modification Example of This Embodiment>

In this embodiment, determination is made as to whether or not to execute circulation on the basis of the temperature, the humidity, and the concentration of the black ink. However, determination as to whether or not to execute circulation may be made on the basis of at least one of the temperature, the humidity, and the concentration of the black ink.

<With Regard to Effect of This Embodiment>

In this embodiment, circulation of the black ink in the wiping sequence is not performed in accordance with installation environment of the recording apparatus 1, and thus it is possible to further shorten time necessary for the wiping sequence in comparison to the third embodiment.

Seventh Embodiment

In the above-described embodiment, description has been given of a case where preliminary ejection is performed after a cleaning process such as wiping. In contrast, in this embodiment, description will be given of a case where preliminary ejection (referred to as "preliminary ejection before recording") is performed at a timing of opening a cap when using the recording apparatus 1 that is not used for a long period of time (that is, the ejection port surface 8*a* is capped with the cap unit 10 for a long period of time). The preliminary ejection before recording represents preliminary ejection that is performed before the recording operation after receiving a recording command, and includes preliminary ejection in a cap-open state, and preliminary ejection in a cap-close state. Furthermore, as in the third to sixth embodiments, in this embodiment, assumption is also made on a case where the black ink and the color ink are used and ON/OFF of ink circulation can be controlled for each color.

<With Regard to Preliminary Ejection Before Recording>

Hereinafter, description will be given of the preliminary ejection before recording according to this embodiment. First, the print controller 202 acquires a duration (referred to as "capping time") of a non-used state of the recording apparatus 1. Furthermore, the recording apparatus 1 includes a timer that can count a non-used state time (capping time), and the print controller 202 can acquire the capping time at arbitrary timing.

Subsequently, the print controller 202 controls circulation and preliminary ejection at circulation systems of respective colors by using a table used in FIG. 20 on the basis of the capping time that is acquired. Furthermore, the table in FIG. 20 is illustrative only, and another table may be used. A table that defines the capping time and operation contents (specifically, as to whether or not to execute circulation, and the number of times of ejection per one nozzle) in the preliminary ejection before recording are stored in the ROM 203 in advance. The print controller 202 derives operation contents corresponding to the capping time that is acquired with reference to the table.

In the case of using the table in FIG. 20, in the circulation system of the black ink, ink circulation is performed in the preliminary ejection before recording, and the preliminary ejection is performed after passage of a predetermined time. In addition, the longer the capping time is, the greater the number of times of ejection per one nozzle is. The reason for this is as follows. The longer the capping time is, the further ink concentration proceeds, and thus it is necessary to discharge a large amount of concentrated ink. Furthermore, in the circulation system of the color ink, ink circulation is not performed in the preliminary ejection before recording, and the longer the capping time is, the greater the number of times of preliminary ejection per ejection port is.

<With Regard to Effect of This Embodiment>

In the circulation system of the black ink according to this embodiment, in the preliminary ejection before recording, the preliminary ejection is performed after dispersing concentrated ink through circulation. According to this, it is possible to reduce concentrated ink that residues inside the ejection port 1006 during capping, and thus an ejection failure in the ejection port 1006 is prevented, and the discharge amount of the black ink through the preliminary ejection is reduced. As described above, with regard to the black ink that is likely to be thickened, the discharge amount thereof is reduced, and thus it is possible to reduce a risk such as clogging due to deposition of waste ink. As a result, reliability is improved.

On the other hand, in the circulation system of the color ink according to this embodiment, the preliminary ejection is performed in the preliminary ejection before recording with a discharge amount set to be greater than a discharge amount in the circulation system of the black ink, and thus concentration of the color ink in the circulation system is suppressed.

Eighth Embodiment

In the seventh embodiment, description has been given of a case where the circulation and the preliminary ejection are performed against concentration inside the ejection port 1006 which occurs during capping. In contrast, in this embodiment, description will be given of a case where only the circulation is performed against the concentration inside the ejection port 1006 which occurs in wiping (that is, in a cap-open state.

<With Regard to Wiping Sequence>

Figure 21A:
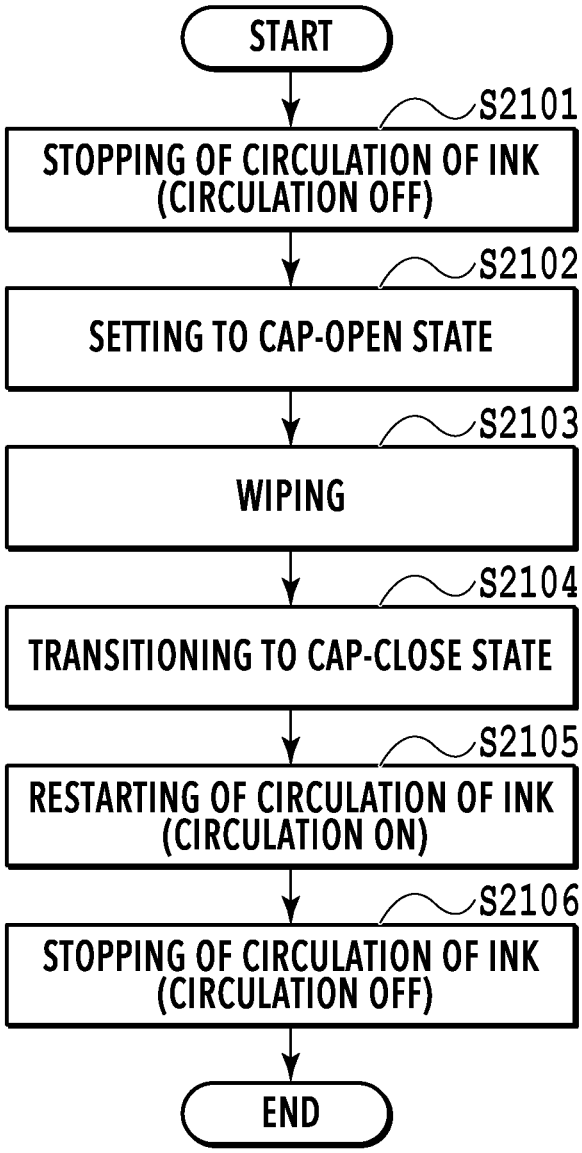
FIGS. 21A and 21B are flowcharts of a wiping sequence according to an eighth embodiment.

Hereinafter, description will be given of a wiping sequence according to this embodiment with reference to FIG. 21A. Furthermore, the following sequence is performed for every circulation system of each color.

In step S2101, the print controller 202 controls the ink supply control unit 209 to stop ink circulation in the circulation system (circulation OFF).

In step S2102, the print controller 202 controls the maintenance control unit 210 to move the cap unit 10 that caps the ejection port surface 8*a*, thereby setting the recording head 8 to a cap-open state.

In step S2103, the print controller 202 controls the maintenance control unit 210 to drive the blade wiper 171*a* so as to wipe the ejection port surface 8*a* (that is, the first wiping process). Furthermore, other cleaning processes such as the second wiping process and the cap suction process may be performed instead of the first wiping process.

In step S2104, the print controller 202 controls the maintenance control unit 210 to move the cap unit 10 that does not cap the ejection port surface 8*a*, thereby transitioning the recording head 8 from the cap-open state to a cap-close state.

In step S2105, the print controller 202 controls the ink supply control unit 209 to restart ink circulation in the circulation system (circulation ON). Furthermore, in this embodiment, it is necessary to further lengthen an ink circulation time (approximately 15 to 30 seconds) in comparison to the above-described embodiments so as to realize restoration of ejection stability through only the ink circulation (without performing the preliminary ejection).

In step S2106, the print controller 202 controls the ink supply control unit 209 to stop the ink circulation in the circulation system (circulation OFF). The above-described configuration corresponds to the contents of the wiping sequence in this embodiment.

<With Regard to Modification Example of This Embodiment>

Figure 21B:
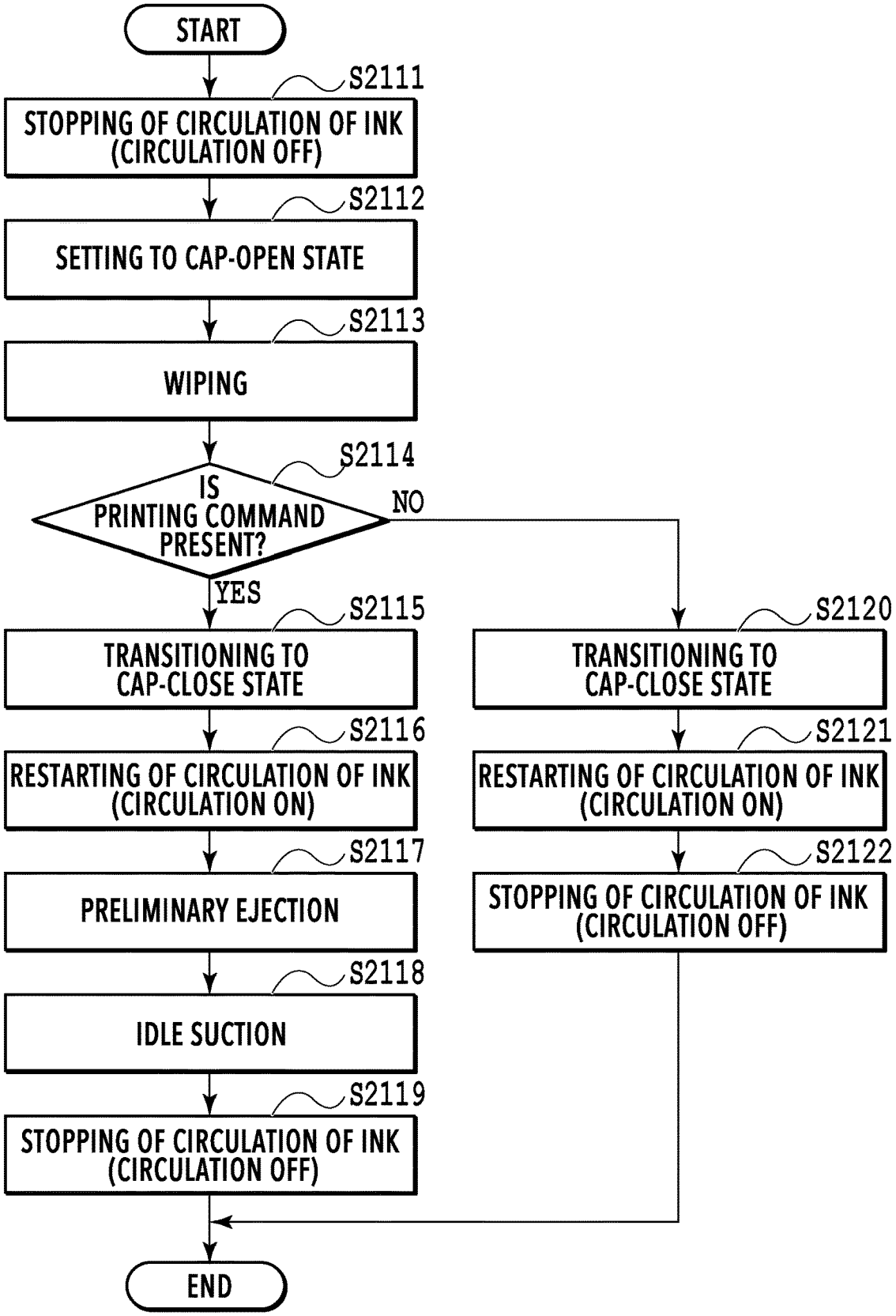

Furthermore, it is possible to determine whether or not to perform the ink circulation in the cap-close state in correspondence with as to whether or not a printing command is present after wiping. Hereinafter, description will be given of a wiping sequence according to this modification example with reference to FIG. 21B.

Steps S2111 to S2113 are similar to steps S2101 to S2103. In step S2114, the print controller 202 determines whether or not a printing command is present. In a case where a determination result is YES, the process proceeds to step S2115, and in a case where the determination result is NO, the process proceeds to step S2120.

In step S2115, the print controller 202 controls the maintenance control unit 210 to move the cap unit 10 that does not cap the ejection port surface 8*a*, thereby transitioning the recording head 8 from the cap-open state to a cap-close state.

In step S2116, the print controller 202 controls the ink supply control unit 209 to restart ink circulation in the circulation system (circulation ON). Furthermore, the preliminary ejection is performed in the subsequent step S2117, and thus an ink circulation time in this step may be shorter in comparison to step S2105.

In step S2117, the print controller 202 drives the recording element 1004 to perform the preliminary ejection of ink.

In step S2118, the print controller 202 controls the maintenance control unit 210 to perform idle suction. The idle suction is performed in a state in which the cap member 10*a* communicates with the air. When the idle suction is performed, ink that is impacted to an absorbing body of the cap member 10*a* is suctioned, and is discharged from the cap member 10*a*.

In step S2119, the print controller 202 controls the ink supply control unit 209 to stop the ink circulation in the circulation system (circulation OFF). As described above, in a case where the printing command is present (YES in step S2114), the preliminary ejection or the idle suction is performed in addition to the ink circulation, and thus the ejection stability is restored at an early stage in comparison to a case where the printing command is not present. Furthermore, steps S2120 to S2122 are similar to steps S2104 to S2106.

<With Regard to Effect of This Embodiment>

In this embodiment, only the ink circulation is performed after wiping, and the preliminary ejection is not performed. Accordingly, it is possible to further reduce the amount of waste ink in comparison to the above-described embodiments by an amount corresponding to not-performing of the preliminary ejection. Accordingly, it is possible to reduce a risk such as clogging due to deposition of waste ink. As a result, reliability is improved. In addition, in a case where the printing command is present, the recording head 8 is restored through the preliminary ejection and the like, and thus it is possible to shorten time (first print-out time (FPOT) taken to initiate the recording operation.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

According to the invention, it is possible to normally perform the preliminary ejection after the cleaning process.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-133530 filed Jul. 7, 2017, which is hereby incorporated by reference herein in its entirety.

What is claimed is:

1. A recording apparatus comprising:

a recording head that includes first ejection ports that eject a first liquid from a first tank in which the first liquid is stored and second ejection ports that eject a second liquid different from the first liquid from a second tank in which the second liquid is stored, the recording head being configured to perform a recording operation by ejecting the first liquid from the first ejection port and the second liquid from the second ejection ports based on recording data;

a circulation unit configured to perform a circulation operation of circulating the first liquid in a circulation route including the recording head; and a cleaning unit that performs a cleaning operation of the recording head including the first ejection ports and the second ejection ports by wiping;

wherein the recording head performs a preliminary ejection operation which is ejection of the first liquid and the second liquid being differentiated from ejection of the first liquid and the second liquid based on the recording data, wherein the recording apparatus performs a first operation: the circulation unit performs the circulation operation and the cleaning unit performs the cleaning operation of the first ejection ports, then the recording head performs the preliminary ejection operation of the first liquid, and a second operation: the cleaning unit performs the cleaning operation of the second ejection ports and the circulation unit does not circulate the second liquid, and then the recording head performs the preliminary ejection operation of the second liquid, and wherein the first operation and the second operation are performed in parallel.

2. The recording apparatus according to claim 1, wherein the circulation unit performs the circulation operation while performing the preliminary ejection operation.

3. The recording apparatus according to claim 2, wherein an ejecting amount of the first liquid per unit time during the preliminary ejection operation is greater than a flow rate of the first liquid per unit time during the circulation operation.

4. The recording apparatus according to claim 1, wherein the recording unit starts to perform the preliminary ejection operation after performing the circulation operation for a predetermined time.

5. The recording apparatus according to claim 1, wherein the cleaning unit includes a wiper that wipes an ejection port surface provided with the first ejection ports and the second ejection ports.

6. The recording apparatus according to claim 1, wherein the cleaning unit includes a vacuum wiper that wipes an ejection port surface provided with the first ejection ports and the second ejection ports while sucking the first ejection ports and the second ejection ports.

7. The recording apparatus according to claim 1, wherein the cleaning unit includes a suction pump that sucks the first ejection ports and the second ejection ports.

8. The recording apparatus according to claim 1, further comprising:

a cap that caps the first ejection ports and the second ejection ports;

wherein the circulation operation and the preliminary ejection operation are performed in a state in which the first ejection ports and the second ejection ports are capped by the cap.

9. The recording apparatus according to claim 1, wherein the recording head includes at least one printing element for generating energy used for ejecting ink corresponding to one of the first ejection ports and at least one first pressure chamber which is an area facing to the printing element, wherein the first ejection opening ejects ink supplied in the pressure chamber, and wherein the circulation route includes the first pressure chamber.

10. The recording apparatus according to claim 1, wherein the first ejection ports and the second ejection ports are arranged in an area corresponding to a width of a recording medium.

11. The recording apparatus according to claim 1, wherein the first liquid is black ink.

12. The recording apparatus according to claim 1, wherein the second liquid is color ink.

13. The recording apparatus according to claim 1, wherein the cleaning unit performs the cleaning operation of the second liquid, and then the recording head performs the preliminary ejection operation of the second liquid without circulating the second liquid by the circulation unit.

14. The recording apparatus according to claim 1, wherein the circulation unit performs the circulation operation and the cleaning unit performs the cleaning operation of the first ejection ports and the second ejection ports, and then the recording head performs a preliminary ejection operation of the first liquid and the second liquid.

15. A recording apparatus comprising:

a recording head that includes (i) first ejection ports that eject a first liquid from a first tank in which the first liquid is stored and second ejection ports that eject a second liquid different from the first liquid from a second tank in which the second liquid is stored, (ii) a printing element for generating energy used for ejecting ink corresponding to one of the first ejection ports, and (iii) a first pressure chamber which is an area facing to the printing element, wherein the first ejection opening ejects ink supplied in the pressure chamber, the recording head being configured to perform a recording operation by ejecting the first liquid from the first ejection ports and the second liquid from the second ejection ports based on recording data;

a circulation unit configured to perform a circulation operation of circulating the first liquid in a circulation route including the pressure chamber; and a cleaning unit that performs a cleaning operation of the recording head including the ejection ports by wiping;

wherein the recording head performs a preliminary ejection operation which is ejection of the first liquid and the second liquid being differentiated from ejection of the first liquid and the second liquid based on the recording data, wherein the recording apparatus performs a first operation: the circulation unit performs the circulation operation and the cleaning unit performs the cleaning operation of the first ejection ports, then the recording head performs the preliminary ejection operation of the first liquid, and a second operation: the cleaning unit performs the cleaning operation of the second ejection ports and the circulation unit does not circulate the second liquid, and then the recording head performs the preliminary ejection operation of the second liquid, and wherein the first operation and the second operation are performed in parallel.

16. The recording apparatus according to claim 15, wherein the circulation unit performs the circulation operation while performing the preliminary ejection operation.

17. The recording apparatus according to claim 16, wherein an ejecting amount of the first liquid per unit time during the preliminary ejection operation is greater than a flow rate of the first liquid per unit time during the circulation operation.

18. The recording apparatus according to claim 15, wherein the control unit starts to perform the preliminary ejection operation after performing the circulation operation for a predetermined time.

19. The recording apparatus according to claim 15, wherein the cleaning unit includes a wiper that wipes an ejection port surface provided with the first ejection ports and the second ejection ports.

20. The recording apparatus according to claim 15, wherein the cleaning unit includes a vacuum wiper that wipes an ejection port surface provided with the first ejection ports and the second ejection ports while sucking the first ejection ports and the second ejection ports.

21. The recording apparatus according to claim 15, further comprising:

a cap that caps the first ejection ports and the second ejection ports;

wherein the circulation operation and the preliminary ejection operation are performed in a state in which the first ejection ports and the second ejection ports are capped by the cap.

22. The recording apparatus according to claim 15, wherein the first ejection ports and the second ejection ports are arranged in an area corresponding to a width of a recording medium.

23. A recording apparatus comprising:

a recording head that includes first ejection ports that eject a first liquid from a first tank in which the first liquid is stored and second ejection ports that eject a second liquid different from the first liquid from a second tank in which the second liquid is stored, the recording head being configured to perform a recording operation by ejecting the first liquid from the first ejection ports and the second liquid from the second ejection ports based on recording data;

a first supply path configured to supply the first liquid from the first tank to the first ejection ports;

a first flow path configured to flow the first liquid which is supplied from a tank and passes a point in the first supply path to a tank side relative to the point of the first supply path;

a circulation unit configured to perform a circulation operation of circulating the first liquid in a circulation route including at least part of the first supply path and the first flow path; and a cleaning unit that performs a cleaning operation of the recording head including the first ejection ports and the second ejection ports by wiping;

wherein the recording head performs a preliminary ejection operation which is ejection of the liquid being differentiated from the ejection of liquid based on the recording data, wherein the recording apparatus performs a first operation: the circulation unit performs the circulation operation and the cleaning unit performs the cleaning operation of the first ejection ports and the second ejection ports, and then the recording head performs a preliminary ejection operation of the first liquid and the second liquid, and a second operation: the cleaning unit performs the cleaning operation of the second ejection ports and the circulation unit does not circulate the second liquid, and then the recording head performs the preliminary ejection operation of the second liquid, and wherein the first operation and the second operation are performed in parallel.

* * * * *